US008221034B2

(12) United States Patent
Wissmann et al.

(10) Patent No.: US 8,221,034 B2
(45) Date of Patent: Jul. 17, 2012

(54) METHODS OF PROVIDING A SUPPORT COLUMN

(75) Inventors: Kord J. Wissmann, Mooresville, NC (US); Alan L. Moxhay, Brighton (GB); Nathaniel S. Fox, Las Vegas, NV (US); Gale M. Peterson, Reinbeck, IA (US)

(73) Assignee: Geopier Foundation Company, Inc., Mooresville, NC (US)

( * ) Notice: Subject to any disclaimer, the term of this patent is extended or adjusted under 35 U.S.C. 154(b) by 0 days.

(21) Appl. No.: 13/279,833

(22) Filed: Oct. 24, 2011

(65) Prior Publication Data

US 2012/0093590 A1 Apr. 19, 2012

Related U.S. Application Data

(60) Division of application No. 11/979,558, filed on Nov. 5, 2007, now Pat. No. 8,043,028, which is a continuation-in-part of application No. 11/101,599, filed on Apr. 8, 2005, now Pat. No. 7,326,004.

(60) Provisional application No. 60/622,363, filed on Oct. 27, 2004, provisional application No. 60/623,350, filed on Oct. 29, 2004.

(51) Int. Cl.
*E02D 3/08* (2006.01)

(52) U.S. Cl. ..... 405/242

(58) Field of Classification Search ..... 405/242, 405/232, 245, 255, 251, 248, 249
See application file for complete search history.

(56) References Cited

U.S. PATENT DOCUMENTS

| | | | | |
|---|---|---|---|---|
| 2,036,355 | A * | 4/1936 | Orr et al. | 405/233 |
| 2,437,043 | A * | 3/1948 | Riemenschneider et al. | 405/246 |
| 3,316,722 | A * | 5/1967 | Gibbons et al. | 405/245 |
| 3,344,611 | A * | 10/1967 | Philo | 405/240 |
| 5,249,892 | A * | 10/1993 | Fox et al. | 405/233 |
| 5,797,705 | A * | 8/1998 | Kellner | 405/253 |
| 8,043,028 | B2 * | 10/2011 | Wissmann et al. | 405/242 |

* cited by examiner

*Primary Examiner* — John Kreck
(74) *Attorney, Agent, or Firm* — Ward and Smith, P.A.

(57) ABSTRACT

A primary earth penetrating mandrel formed of a hollow shell steel plate octagonal in cross-section has an upper end and a blunt lower end joined by an upwardly and outwardly tapered wall. The mandrel is driven down in the earth to simultaneously form a vertical tapered cavity while compacting the sidewall of the cavity to provide structural integrity. The mandrel is then moved upwardly from the bottom of the cavity and aggregate is deposited in the bottom of the cavity then the mandrel is lowered so that its blunt lower end densifies the aggregate by vertical vibratory action and static force and repeating these until the pier top is near the surface of the earth at which time the upper aggregate portions are densified by the primary mandrel or a secondary mandrel having a substantially larger lower end surface than the lower end surface of the primary mandrel.

9 Claims, 16 Drawing Sheets

METHODS OF PROVIDING A SUPPORT COLUMN

CROSS-REFERENCE TO RELATED APPLICATIONS

The present utility application is a divisional application of U.S. application Ser. No. 11/979,558 filed on Nov. 5, 2007. U.S. application Ser. No. 11/979,558 is a continuation-in-part application of U.S. application Ser. No. 11/101,599 filed on Apr. 8, 2005, which issued on Feb. 5, 2008 as U.S. Pat. No. 7,326,004. U.S. application Ser. No. 11/101,599 is a utility patent application partially based on, and claiming priority from, U.S. Provisional Application No. 60/622,363 filed on Oct. 27, 2004 and U.S. Provisional Application No. 60/623,350 filed on Oct. 29, 2004. The disclosures of each of the above-referenced applications are hereby expressly incorporated herein in their entirety by reference.

BACKGROUND OF THE INVENTION

1. Technical Field

In a principal aspect, the present invention generally relates to a method of soil densification and improvement for the purpose of forming a stiffened support pier in a cavity within the densified and improved soil.

The present invention additionally relates generally to the field of civil and construction engineering and, more specifically, is directed to methods and apparatus for providing load supporting aggregate piers in the earth capable of supporting a multitude of possible structures including, but not limited to, buildings, roads, bridges and the like.

2. Background Art

Many soils are deficient in their capability to incorporate a shallow support system such as shallow foundations or a shallow mat system. Consequently, when building a structure, highway embankment or retaining wall, it is often necessary to provide a special foundation support for the structure and various techniques have been developed to provide adequate subsoil support for such structures to prevent excessive settlements and to prevent bearing failures. For example, pilings may be driven into the ground to bedrock. Various techniques have also been developed for densifying and improving the ground and utilizing the improved ground in combination with pilings or stiffened piers or footings constructed therein.

It has been conventional practice for many years to provide vertical, elongated cavities in the earth for receiving aggregate to form what is known as "stone columns". In one conventional procedure cavities are formed by vertically vibrating a vibroflot cylindrical tube into the ground. The vibroflot tube has motor driven eccentric weights in its lower end for applying lateral or radial vibrations to the tube and the short conical tool. Penetration of the earth by the tube is assisted by either air or water jetting means. Older devices of the foregoing type use water jetting means and drop aggregate, crushed stone or other granular materials into the cavity from the ground surface in what is referred to as a "wet method". More recent variations have employed air jetting and introduction of stone through the tube.

Major problems with the wet method process are that it adds water to the cohesive clay soils around the vibroflot so as to soften the soil, and it produces effluent containing suspended particles that is often required to be treated. Unfortunately, the application of horizontal vibration applied to the stone results in a column having low stiffness in comparison to short aggregate piers as discussed in the following paragraphs.

A more recently employed method of providing short aggregate piers is that of Fox et al. U.S. Pat. No. 5,249,892, which teaches use of a rotary drill to form a cavity typically of 18 to 36 inches in diameter, in the manner discussed in column 5, of the patent. Upon completion of the cavity, a thin lift (layer) of aggregate is placed in the bottom of the cavity and compacted vertically and outwardly by high energy impact devices (hydraulic hammers) applying direct downward and high frequency ramming to each thin lift of stone with the procedure then being repeated with subsequent thin stone lifts until the cavity is filled to complete the short pier. Shortcomings of such procedures include the required use of a casing to stabilize the sidewalls of the cavity above its lower end, when installations are in unstable soils which cave in, such as sands and sandy silts. Also, instability at the bottom of the cavity in granular soils with a high groundwater level is a frequent problem because of the water attempting to flow or pipe into the casing so as to create unstable conditions at the bottom of the cavity. Moreover, the depth of the cavity is limited to approximately 30 feet because of structural limitations of the equipment. A further problem arises in soft, cohesive or organic soils in which the load capacity of the pier to support loads is limited by the fact that the soft soil provides limited resistance to outward bulging movement of the stone piers.

Fox U.S. Pat. No. 6,354,766 discloses a variety of special techniques, including pre-loading, chemical treatment and use of mesh reinforcement procedures to enhance the construction and test the properties of short aggregate piers.

Fox U.S. Pat. No. 6,354,768 discloses the use of expandable bladders for densifying soil adjacent or below stone piers.

Another method of forming a stone pier is disclosed in U.S. Pat. No. 6,425,713 in which a lateral displacement pier, also know as a "cyclone pier", is constructed by driving a pipe into the ground, drilling out the soil inside the pipe and filling the pipe with aggregate. The pipe is then used to compact aggregate in thin lifts by use of a beveled edge at the bottom of the pier for compaction. Piers fortified by this method can be installed to great depths such as 50 feet and in granular soils. Limitations of this approach include the need for a heavy crane for installation and a drill rig to drill out the casing. Additionally, the system is cumbersome and slow to install when the installation uses a normal crane and pipe having diameters such as listed in the patent.

Another system developed by Mobius and Huesker in Germany provides an encased stone column by pushing a closed-ended pipe into soft ground by use of a vibratory pile driving hammer mounted at the top of the pipe. When the lower end of the pipe reaches designed depth, a geotextile sock or bag is inserted into the inside of the pipe. This sock is then filled with crushed stone poured from the ground surface. After the sock is filled a trap-door opens at the bottom of the pipe and the pipe is extracted upwardly while the geotextile sock and its contents remain in the excavation. The primary advantage of this system is that the geotextile sock prevents the bulging of the crushed stone into the surrounding soil when loaded. However, a number of disadvantages include the fact that the column is not compacted and does not have high stiffness sufficient for supporting buildings and the like. Additionally, this system must be installed in very soft or loose soil that can be penetrated by closed-ended pipe pile driven with a vibratory pile driving hammer.

Another prior system developed by Nathaniel S. Fox employs a 14 inch to 16 inch diameter tamper head attached to the lower end of an 8 inch to 10 inch diameter cylindrical pipe. The pipe is vibrated into the ground and is filled with crushed stone once the tamper head is driven to the desired designed depth. The tamper head is then lifted to allow stone to fall into the cavity following which the tamper head is driven back downwardly onto the stone for densifying the stone.

A deep dynamic compaction system developed by Louis Menard employs a heavy weight which is dropped from a great height to pound the ground. Each drop creates a crater at the ground surface and generates significant ground shaking and causes granular soils to densify for the future support of structures. The system can be employed by placing fresh stone in the cavities formed by the dropped weight and then tapping the stone downward to form stone pillars used to support vertical loads. Similar methods are illustrated in United Kingdom Patent No. 369,816, Italian Patent No. 565, 012, and French Patent No. 616,470. The disadvantages of these processes include the need for a large crane to lift the dropped weight and the excessive vibration that is induced during tamping.

Another system for making aggregate piers, involving driving a pointed mandrel has been used by a contractor in the United Kingdom and is disclosed in a brochure of Roger Bullivant Ltd dated June 2002. The disclosed device uses a vibrator piling hammer to direct the mandrel into the ground to provide a cavity for receipt of crushed stone. The mandrel has a sharply pointed end, which inhibits the compaction of the stone at the top of the pier.

Densification of the soil and construction of a stiffened pier column using the techniques of the type described in the aforesaid prior art comprises a mechanical densification process. Various mechanical means are utilized to alter, densify and otherwise improve the characteristics of the soil enabling the soil to effectively incorporate support piers. The process also produces a stiffened pier, which in combination with the improved adjacent soil, results in an effective structural support system for shallow foundations, slabs and mats.

A problem typically arises in sandy soil and other unstable soils in that drilled holes often cave in and require expensive preventive measures to prevent the cave-ins. Another problem with drilled holes is that cuttings are brought to the ground surface and they require disposal. This later problem is particularly onerous when the soils being penetrated are contaminated, since disposal of contaminated soils is extremely expensive.

BRIEF SUMMARY OF THE INVENTION

Therefore, it is the object of the present invention to provide new and improved methods and apparatus for forming aggregate piers.

A more specific object is the provision of new and improved methods and apparatus for forming cavities in the earth that maintain their structural integrity during construction of stone piers or columns in such cavities.

Another object of the present invention is the provision of new and improved methods for radially compacting the side wall of a cavity as it is being formed so as to reduce the possibility of side wall deterioration during subsequent construction procedures.

A further object of the present invention is to provide improved apparatus and methods for soil densification and improvement in forming a cavity and a stiffened support pier therein.

Another object is to provide an improvement in the strength and stiffness of the piers by producing improved methods for aggregate compaction during construction of the pier shaft and the top of the pier.

Another object of the invention is the provision of vertical impact energy and downward static forces applied by the top-mounted hammers used for construction.

Another object of the invention is to provide an improved method and apparatus for soil densification and formation of a stiffened structural support pier of aggregate or aggregate and cementitious grout in soils of various types, and, in particular, granular soils such as sandy soils.

It is a further object of the invention to provide a method and apparatus for mechanical densification of the soil and formation of stiffened piers that is more efficient than prior techniques and which may be used in a wider range of soils.

Yet another object of the invention is to provide a method and apparatus for soil densification, wherein a stiffened pier is formed within a passage or cavity in the soil, and wherein the pier or support includes either a single stage construction or multiple stage construction depending upon the characteristics of the soil being densified and on the results needed in design.

It is a further object of the invention to provide a method for formation of a support pier in soils, particularly granular soils and contaminated soils, where the formed support pier comprises an aggregate or an aggregate with cementitious grout, within soil that has been densified and strengthened by pre-straining and pre-stressing the soil in the vicinity of the formed pier.

It is yet another object of the invention to provide a method of forming a support pier in soil types that are incapable of forming a self-supporting cavity before the deposition of aggregate.

Yet another object of the invention is to provide a method of and apparatus for forming aggregate piers that includes a mandrel bottom cap which is not only removable, but recoverable for subsequent reuse.

Other objects, features and advantages of the present invention will be apparent to those skilled in the art upon consideration of this specification and the accompanying drawings.

Achievement of the foregoing objects of the present invention is enabled by a unique primary mandrel for forming cavities in the earth which tapers inwardly from its upper end to a blunt lower end with the distance between the upper end and the lower end being at least equal to the height of the aggregate pier to be formed in a cavity formed by the primary mandrel. Typically, the taper or pitch angle of the primary mandrel relative to the axis of the mandrel is constant and will fall in the range of about 1.0 to about 5.0 degrees so that vertical movement of the mandrel which is effected by both vertical static force and vertical vibratory force creates essentially lateral radial forces on the surrounding earth. These lateral radial forces serve to compact and stabilize the entire sidewall surface of the cavity being formed and consequently greatly reduce the possibility of subsequent loss of structural integrity of the cavity during the extraction of the mandrel. The pitch angle of the primary mandrel is selected for different soil profiles to achieve enhanced stability so that the mandrel may be lifted from the cavity without the need for temporary casing or drilling fluid to maintain sidewall stability. It is also consequently possible to avoid the need for temporary casing or drilling fluid to maintain sidewall stability during the deposit and compaction of aggregate deposited in the open cavity during subsequent pier building procedures.

Upon completion of the cavity the primary mandrel is removed upwardly from the bottom of the cavity to enable the beginning of construction of a pier by deposit of a layer of aggregate on the bottom of the cavity. The primary mandrel is then reinserted in the cavity and the mandrel's blunt lower end engages the previously deposited aggregate with greater downward static force (crowd force) than achieved for cylindrical vibroflot construction to compact both the aggregate and the soil radially adjacent and in contact with the aggregate. The primary mandrel is again removed from the cavity and another deposit of aggregate is placed upon the previously deposited aggregate. This next deposit of aggregate is then compacted as in the previous compacting procedure by the blunt lower end of the mandrel and the aggregate depositing and compacting procedures are repeated until the aggregate nears the upper end of the cavity. Final compaction of the aggregate in the upper end of the cavity to complete the pier construction may optionally be effected by use of a short secondary tamping mandrel having a larger blunt lower end than the primary mandrel employed in forming the cavity.

The unique primary mandrel has a hollow shell-frame preferably formed of steel plate having an octagonal cross-section. However, other cross-sectional shapes could be used, including but not limited to square, hexagonal and circular. The shell-frame is preferably formed of an upper half-shell component and a lower half-shell component which are welded together at the mid-point of the primary mandrel to provide a rugged and effective structure at reduced cost.

The present invention also relates to a method for densification of soil and forming of a stiffened column of aggregate or aggregate with cementitious grout, which comprises a series of steps, including forming a tapered cavity or passage in the soil, filling in that passage or at least in part filling it in, with aggregate or with aggregate with a cementitious grout, compacting the aggregate and at the same time displacing a portion of the aggregate laterally into the adjacent soil to densify and laterally prestress the adjacent soil. The method further contemplates the filling of the passage with aggregate or with aggregate with cementitious grout upward from the bottom of the passage.

The present invention further relates to a method for densification of soil and forming of a stiffened column of aggregate in soil types that are incapable of forming a self-supporting cavity prior to the deposition of aggregate. According to this embodiment of the invention, the method includes forming a passage or cavity in the earth with a mandrel that has an open lower end initially covered by a sacrificial or removable cap. The presence of the mandrel supports the soil of the unstable cavity wall. Then, the mandrel is filled with loose aggregate and slowly raised so as to separate the sacrificial or removable cap from the open lower end of the mandrel and deposit the aggregate in the cavity. The deposited aggregate supports the lower portion of cavity wall that is no longer supported by the partially raised mandrel. The mandrel continues to be slowly raised to ground level, with the deposited aggregate stabilizing the filled cavity wall. Then, a mandrel with a blunt bottom plate is used to sequentially compact the deposited aggregate and densify the surrounding soil.

The present invention further relates to a method of and apparatus for forming aggregate piers that includes a mandrel bottom cap which is not only removable, but recoverable for subsequent reuse. As the mandrel is slowly raised from the bottom of the formed cavity, the removable and recoverable cap is configured to separate from the bottom of the mandrel so as to expose the open lower end of the mandrel. Because the removable and recoverable cap is attached to the mandrel by a tether, the separated cap is withdrawn from the cavity along with the mandrel.

A method of forming the passage is to utilize a long, tapered steel or other hard material mandrel or probe with larger cross-section top portion and smaller cross-section bottom portion. The probe may have a variety of shapes including a circular cross-section. The bottom of the probe may be flat, or it may be flat with beveled sides with a greater taper than the taper of the sides of the main probe, or it may have a different shaped bottom such as a cone point or a convex semi-spherical bottom. Different bottom shapes may be preferable in different types of soil.

The elongated tapered mandrel or probe of the present invention is pushed and optionally vibrated into the ground using a static force, optionally a dynamic force, and optionally a vibrating force, or a combination of these forces. The probe is pushed until it reaches the predetermined depth of improvement desired. The probe is subsequently raised, either in one movement to the top, or in a series of intermediate movements, depending upon the method selected to form the pier.

The method further contemplates densifying the top of the aggregate pier with a secondary probe that has a greater cross-sectional area at the probe bottom than the primary probe.

The method additionally contemplates the use of telltales, uplift anchors and post grating to measure deflections, resist uplift loads and reduce the propensity for bulging.

BRIEF DESCRIPTION OF THE DRAWINGS

The invention is better understood by reading the following Detailed Description of the preferred embodiments with reference to the accompanying drawing Figures, which are not necessarily to scale, and in which like reference numerals refer to like elements throughout, and in which:

FIG. 5(*a*) is a plan view of a lower bulkhead juncture plate for the mandrel of FIG. 1; FIG. 5(*b*) is a pre-assembly exploded side view of the two lower quarter-shell components of the mandrel shell for the mandrel of FIG. 1, illustrating an initial step in the assembly of the lower half-shell component;

FIG. 5(*c*) is a side view of the two lower quarter-shell components of FIG. 5(*b*) in assembled relationship forming the lower half-shell component;

FIG. 6(*a*) is an exploded pre-assembly side view of the two upper quarter-shell components of the mandrel of FIG. 1, illustrating an initial step in the assembly of the upper half-shell components;

FIG. 6(*b*) is a side view of the two upper quarter-shell components of FIG. 6(*a*) illustrating their assembled relationship forming the upper half-shell component;

DETAILED DESCRIPTION OF THE INVENTION

Figure 1:
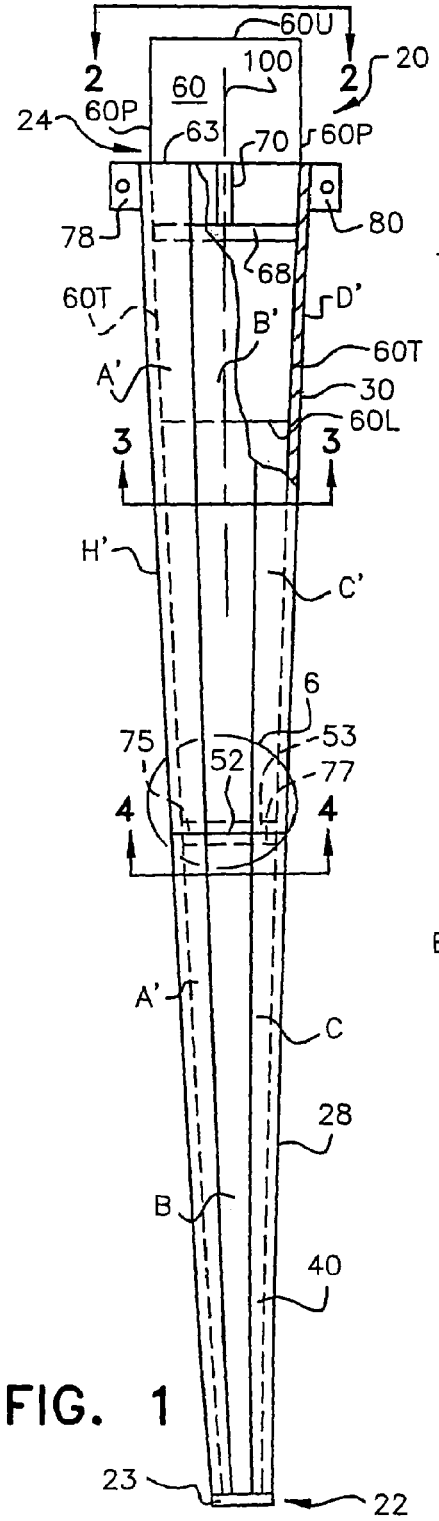
FIG. 1 is a front elevation of a first embodiment earth penetrating primary mandrel employed in practice of the present invention.

In describing preferred embodiments of the present invention as illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose. It should also be understood that the directional and positional descriptions such as above, below, front, rear, upper, lower and the like are based upon the relative positions of the structural components illustrated in FIGS. 1, 2 and 3.

With regard to FIG. 1, the present invention achieves the foregoing objects in a preferred embodiment by employment of a unique primary ground penetrating downwardly tapered mandrel, generally designated 20 (FIG. 1), which is typically about 10 to about 20 feet long and has a longitudinal axis 100. Primary mandrel 20 is often octagonal in cross-section and continuously tapers inwardly with a taper angle of about 1.0 to about 5.0 degrees from its upper end surface 24 to its lower end 22 terminating in a blunt bottom plate 23. Upper end surface 24 of primary mandrel 20 is preferably about 12 to about 30 inches in maximum width and blunt bottom plate 23 has a maximum width of preferably about 4 to about 10 inches. A drive and support plate 60 has its lower portion fixedly mounted in primary mandrel 20 and is supported at its upper end by a conventional pile driving rig generally designated 26 (FIG. 9), which applies both a downward static force and vertical vibratory force for effecting penetration of the earth by the mandrel 20 to form a unique cavity having stable sidewalls in which an aggregate pier is subsequently constructed. Alternately, a downward impact hammer may be used to achieve penetration.

In its preferred form, the main component of primary mandrel 20 is a rigid steel plate shell having a lower half-shell steel plate component 28 and an upper half-shell steel plate component 30. The lower half-shell component 28 is formed of a first quarter-shell component generally designated 28(*a*) and a second quarter-shell component generally designated 28(*b*) (FIGS. 5, 5(*b*), and 5(*c*)). The upper half-shell component 30 is similarly formed of upper quarter-shell components 30(*a*) and 30(*b*) (FIGS. 6(*a*) and 6(*b*)). Half-shell components 28 and 30 are octagonal in cross-section, are coaxially positioned and are joined and welded together at juncture plane 52 (FIG. 1).

Figure 4:
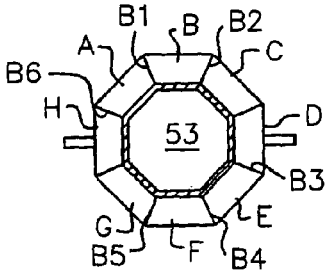
FIG. 4 is a sectional view taken along lines 4-4 of FIG. 1.
Figure 5A:
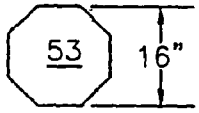
FIG. 5 is an exploded top view of end portions of the two lower quarter-shell components of the mandrel shell for the mandrel of FIG. 1.
Figure 5:
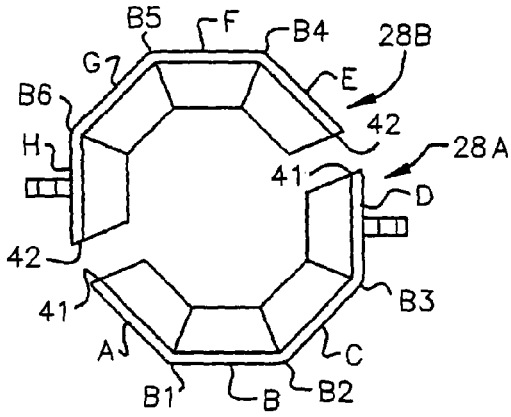

Lower quarter-shell component 28(*a*) is formed with four upwardly and outwardly flaring planar panels A, B, C and D, and lower quarter-shell components 28(*b*) are formed in like manner with upwardly and outwardly flaring panels E, F, G and H (FIG. 4). The lower quarter-shell components 28(*a*) and 28(*b*) are of identical construction and are formed of two respective steel plates each of which is bent by conventional bending apparatus at bend areas B1, B2 and B3 in quarter-shell 28(*a*) to form panels A, B, C and D and at bend areas B4, B5 and B6 in quarter-shell 28(*b*) to form panels E, F, G and H as shown in FIGS. 4 and 5. The lower quarter-shell component 28(*a*) has linear side surfaces 41 which face and are welded to linear side surfaces 42 of lower quarter shell component 28(*b*). Lower quarter-shell components 28(*a*) and 28(*b*) are identical mirror images of each other as shown in FIG. 5 and the resultant lower half-shell 28 is of octagonal transverse cross-section.

Figure 3:
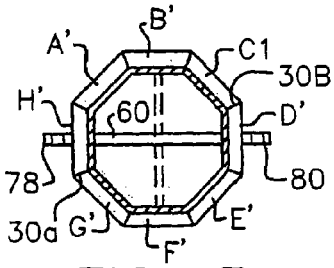
FIG. 3 is a sectional view of the mandrel taken along lines 3-3 of FIG. 1.

The upper quarter-shell components 30(*a*) and 30(*b*) are identical mirror images of each other and are similarly formed from two sheets of steel plate by conventional bending procedures so that they are octagonal in transverse cross-section when assembled together to form upper half-shell 30. Upper half-shell component 30(*a*) includes upwardly and outwardly flaring panels A', B', C' and D' and upper half-shell component 30(*b*) includes upwardly and outwardly flaring panels E', F, G and H' (FIG. 3). The panels A' through H' of upper half-shell 30 are tapered at the same angle from axis 100 as panels A through H of lower half-shell 28. Panels A' through H' also have their lower ends respectively aligned with the upper ends of corresponding panels A through H of the lower half-shell component 28. The upper end surface 50 (FIG. 6) of the lower half-shell 28 faces, but does not engage, the lower end surface 79 of the upper half-shell 30. All of the panels A, A', etc. are oriented at a taper angle of about 1.0 to about 5.0 degrees relative to axis 100 of the primary mandrel with the amount of taper depending upon the type of soil in which the mandrel is intended for use.

Figure 8:
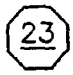
FIG. 8 is a lower plan view of a blunt bottom plate of the mandrel of FIG. 1.
Figure 6A:
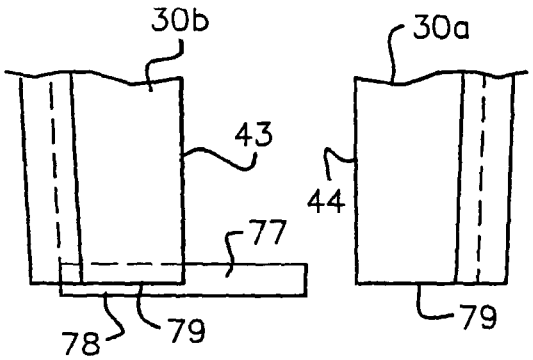
FIG. 6 is encircled portion 6 of FIG. 1 comprising a front elevation partial section view illustrating the connection structure between the upper and lower half-shell components.
Figure 6B:
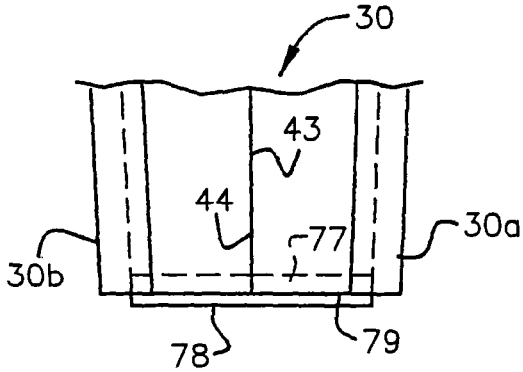
Figure 6:
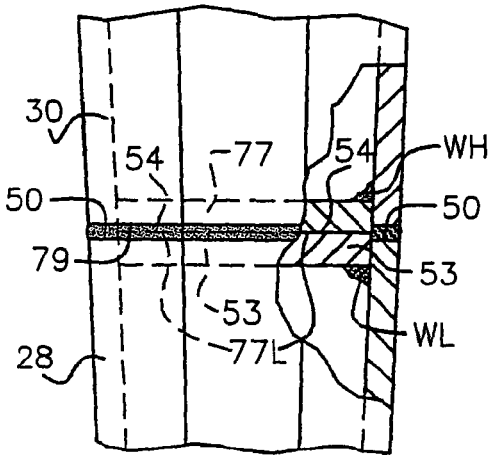

Assembly of the preferred embodiment can begin with the fabrication of lower half-shell 28 by connection of the lower quarter-shell components 28(*a*) and 28(*b*) to form the lower half-shell component 28. Such assembly begins with positioning of the lower mid-bulkhead juncture plane 53 in the upper end of the lower quarter-shell 28(*a*) with its upper surface 54 above the upper end surface 50 of lower quarter-shell 28(*a*) where it is held in the position shown in FIG. 5(*b*) by welding WL (FIG. 6). Typically, the upper surface 54 is approximately 0.5 inches above surface 50. The other lower quarter-shell component 28(*b*) is then positioned in alignment with the lower quarter-shell component 28(*a*) with surfaces 41 and 42 being in facing contact. Facing surfaces 41 and 42 are then welded together. Blunt bottom plate 23 (FIG. 8) is then welded on the lower end of lower half-shell component 28. Lower half-shell component 28 is then ready for connection to the upper half-shell component 30.

Upper half-shell 30 can be assembled in a similar manner as lower half-shell 28 with the initial step being welding of upper mid-bulkhead juncture plate 77 to the inner surface of the lower end of the upper quarter-shell 30(*b*) by welding WH so that the bottom surface 78 of upper mid-bulkhead juncture plate 77 is positioned below lower end surface 79 of upper half-shell 30. Again, the bottom surface 78 is typically positioned about 0.5 inches below surface 79. The upper shell components 30(*a*) and 30(*b*) are then positioned in facing relationship with their longitudinal edges 43 and 44 in facing contact where they are welded together to complete upper half-shell 30 which is then ready for welding to lower half-shell 28.

Connection of the half-shells 28 and 30 begins with positioning of the upper end of the lower half-shell 28 in alignment with the lower end of the upper half-shell 30 and with the upper surface 54 of plate 53 being in face-to-face contact with the bottom surface 78 of upper mid-bulkhead juncture plate 77 as shown in FIG. 6. A circular weld W is effected in the peripheral groove surrounding the outer surfaces of bulkhead juncture plates 53 and 77 between surfaces 50 and 79 to complete the strong connection of the upper half-shell 30 and the lower half-shell 28. Welding of the juncture plates together is made possible because the upper surface 54 of lower juncture plate 53 is positioned above upper surface 50 of half-shell 28 and the bottom surface 78 of upper mid-bulkhead juncture plate 77 is below lower end surface 79 of upper half-shell 30. The vertical spacing between surfaces 50 and 79 provides the peripheral groove, preferably about one inch, in which welding W is provided, as shown in FIG. 6, to bond juncture plate 53 and juncture plate 77 as well as the lower end 79, upper half-shell 30, the upper end 50 and lower half-shell 28 into a unitary rigid structure.

Figure 2:
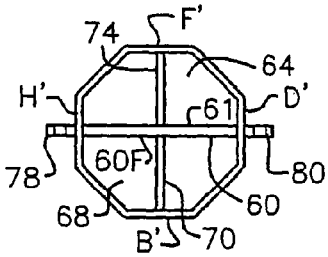
FIG. 2 is a top plan view of the mandrel taken along lines 2-2 of FIG. 1.
Figure 18:
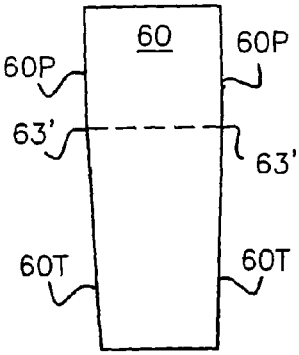
FIG. 18 is a front elevation view of the drive and support plate provided in the upper end of the mandrel of FIG. 1 or 14.

Drive and support plate 60 (FIG. 18) is preferably about 1.5 inches thick and about 48 inches long. Drive and support plate 60 has parallel vertical upper side edges extending downwardly from its upper end 60U to termination line 63' aligned with upper end surface 24 (FIG. 1) of half-shell 30. Lower inwardly tapering edge surfaces 60T extend downwardly below line 63' and are machined to provide planar contact with the inner surface of half-shell 30 in a face-to-face relationship with panels D' and H', which enables welding of portions 60T to such inner surfaces as shown in FIG. 2. The upper end 60 U of drive and support plate 60 is preferably positioned about 18 inches above the upper end surface 63 of upper half-shell 30, and the lower end 60L is preferably about 30 inches below upper end surface 63 of upper half-shell 30.

Figure 16:
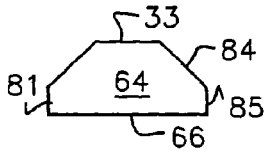
FIG. 16 is a plan view of a rear brace plate provided near the upper end of the mandrel of FIG. 1 or 14.
Figure 17:
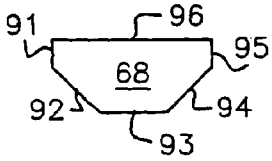
FIG. 17 is a plan view of a front brace plate provided near the upper half of the mandrel of FIG. 1 or 14.

Additionally, bracing for vertical drive and support plate 60 is provided by horizontal rear brace plate 64 having peripheral surfaces 81, 82, 83, 84, 85 and 66 (FIG. 16) and horizontal front brace plate 68 having peripheral surfaces 91, 92, 93, 94, 95 and 69 (FIG. 17). Plates 60, 64 and 68 are all preferably formed of 1.5 inch steel plate. Brace plates 64 and 68 are perpendicular to plate 60 and are preferably positioned about 4 inches below upper end surface 63 of upper half-shell 70. Front surface 66 of brace plate 64 engages and is welded to rear face 61 of drive and support plate 60, and rear face 69 of brace plate 68 engages and is welded to front surface 60F of drive and support plate 60 (FIG. 2).

Side surfaces 81, 82, 83, 84 and 85 of brace plate 64 are machined to engage the inner surfaces of upper half-shell 30 in a face-to-face manner. Similarly, brace plate 68 has surfaces 91, 92, 93, 94 and 95 which engage upper half-shell 30 in a face-to-face manner. All of the contacting surfaces of brace plates 64 and 68 are welded to upper half-shell 30 surfaces which they contact. Additional bracing for drive and support plate 60 is provided by a rear center plate 74 having a front surface welded to the rear surface 61 of drive and support plate 60, a lower surface welded to the front surface of plate 64 and a rear vertical surface welded to the inner surface of panel B'. Similarly, a forward vertical brace plate 70 is welded to the inner surface of panel F, the upper surface of front brace plate 68 and front surface 60F of drive and support plate 60 (FIG. 2).

Figure 9:
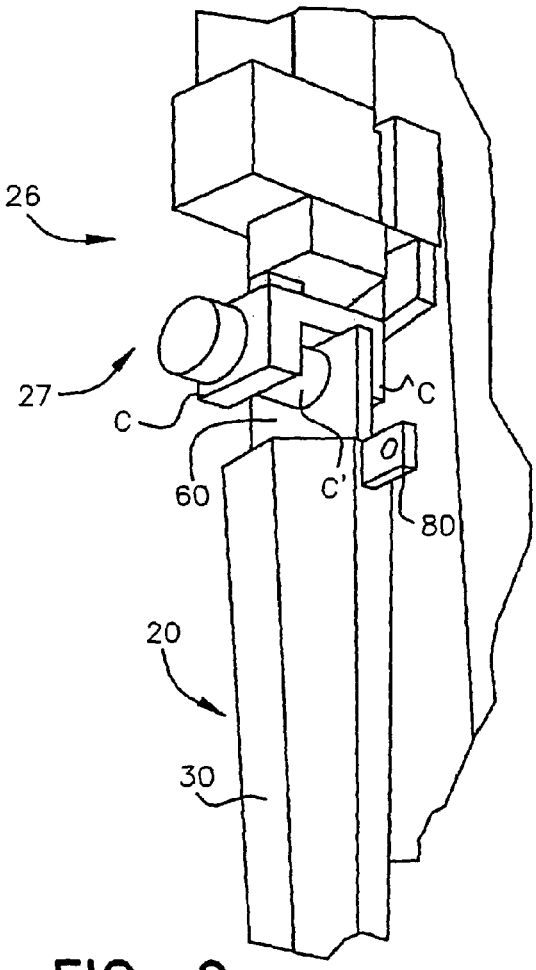
FIG. 9 is a perspective view illustrating association of the primary mandrel of FIG. 1 with a conventional supporting and driving device for driving the mandrel into the earth.
Figure 5B:
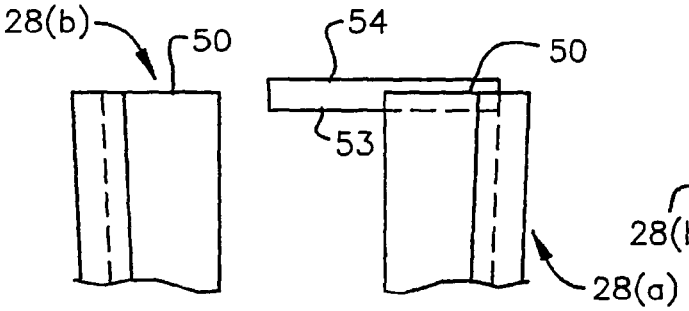
Figure 5C:
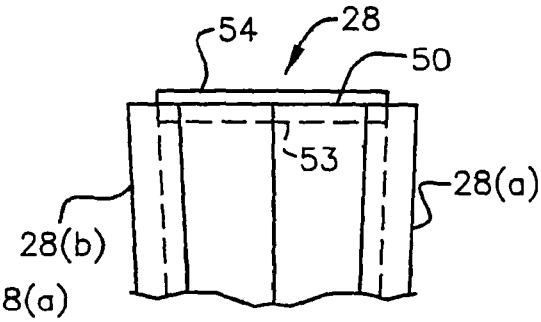

In use, primary mandrel 20 is lifted by cable hooks in ear brackets 101 and 80 welded to upper half-shell 30 so that drive and support plate 60 is vertically positioned and securely held between clamping means C and C' of conventional pile driving rig 26 (FIG. 9). Rig 26 is capable of applying downward direct constant static force and/or vibratory force provided by either a vibratory piling hammer or hydraulic impact hammer to drive and support plate 60. Primary mandrel 20 is consequently prepared to be driven vertically downwardly into the ground to form a cavity in which an aggregate pier is to be constructed. The supporting rig 26 provides both static and vibratory pressure or impact force downwardly on drive and support plate 60 to effect full length movement of the mandrel downwardly into the earth E to form a cavity C (as shown in FIG. 11).

Figure 10:
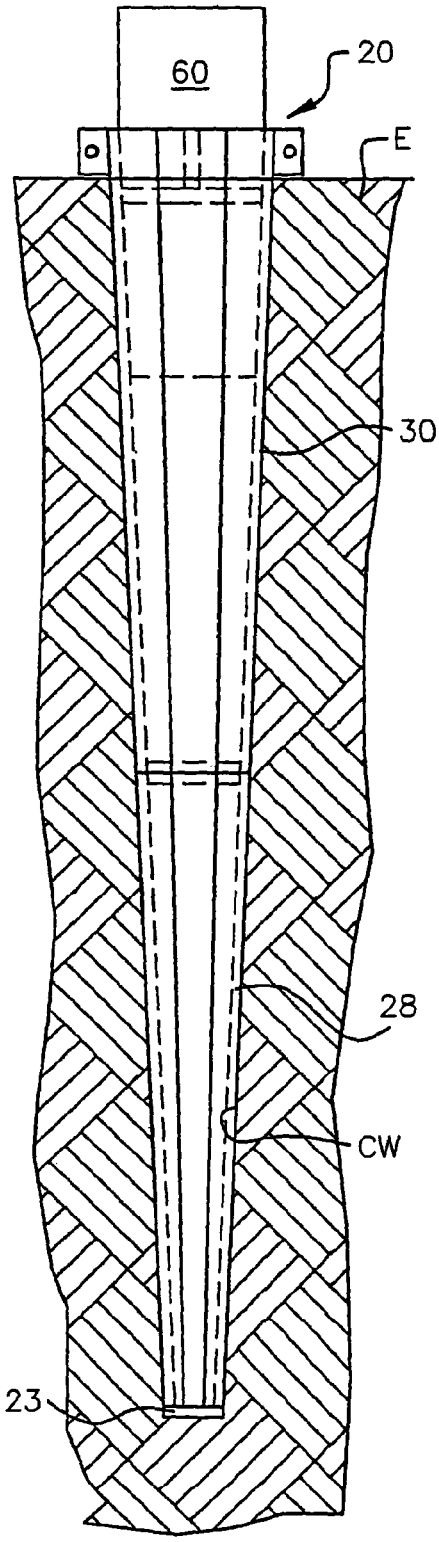
FIG. 10 is a vertical section of the earth illustrating completion by the primary mandrel of FIG. 1 of a cavity in which an aggregate pier is to be constructed.

Movement of primary mandrel 20 from the surface to the FIG. 10 position results in a combination of radial and vertical forces exerted against the surrounding earth to compact the cavity wall CW. This compaction serves to increase the structural integrity of the surrounding earth sufficiently to preclude wall collapse or other failures during subsequent operations in forming a pier in the cavity C.

Figure 11:
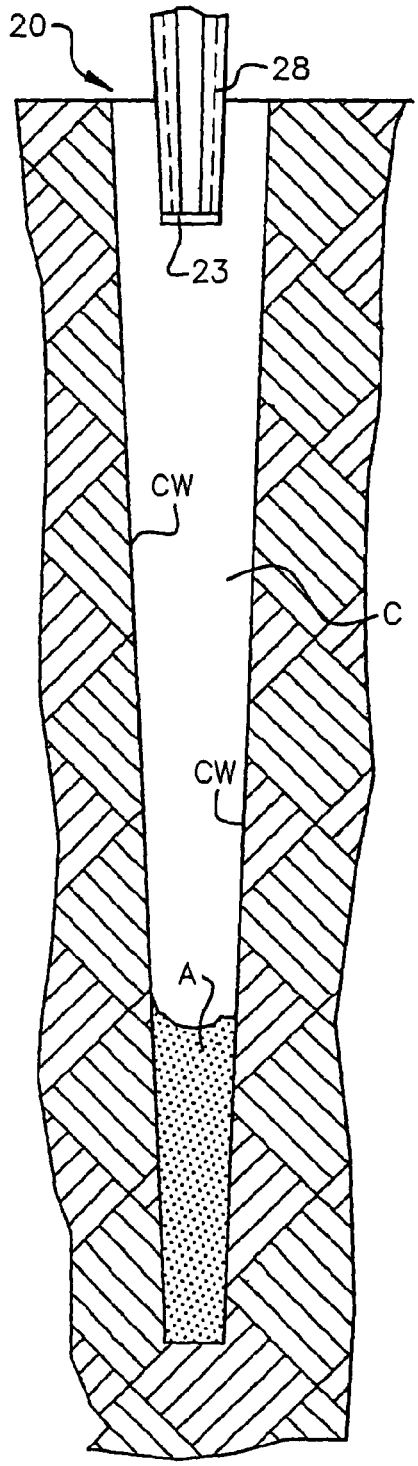
FIG. 11 is a vertical section showing the primary mandrel of FIG. 1 in a second position assumed subsequent to the FIG. 10 position to permit deposit of aggregate in the bottom of the cavity.
Figure 12:
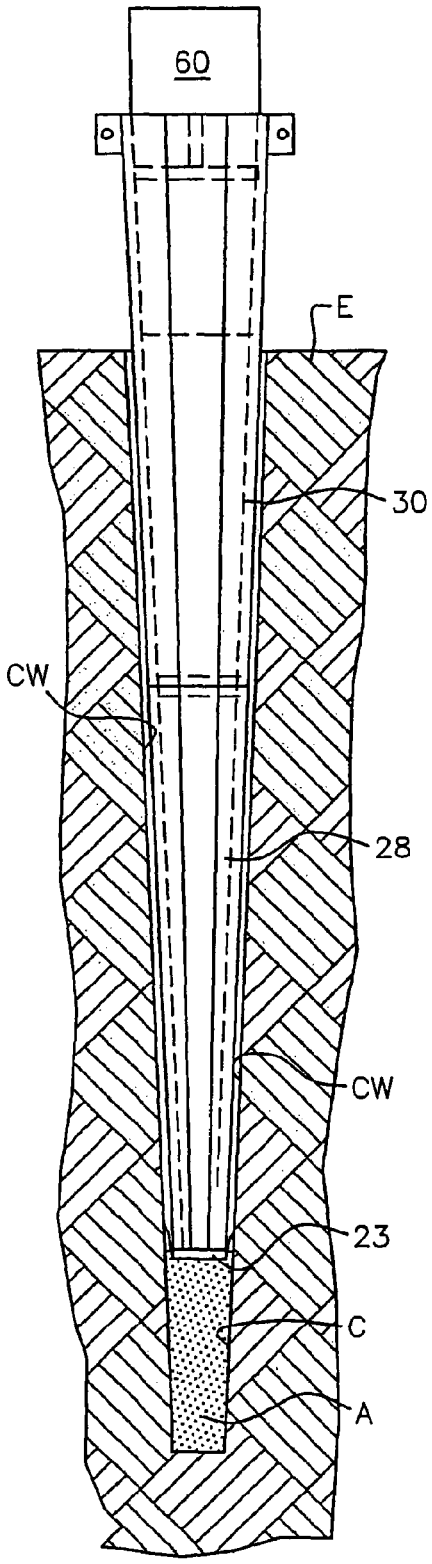
FIG. 12 is a vertical section showing the primary mandrel of FIG. 1 in an aggregate densifying position assumed subsequent to the FIG. 11 position.

Once the cavity C is formed, the primary mandrel 20 is partially or fully withdrawn to the upper end of the cavity as shown in FIG. 11, and a quantity of loose aggregate A is deposited into the bottom end of the cavity as shown in FIG. 11. Primary mandrel 20 is then reintroduced into the cavity and downward static and vibratory or impact forces are applied to the drive and support plate 60 so that the blunt bottom plate 23 on the lower end 28 of the mandrel engages and compresses the previously deposited aggregate as shown in FIG. 12. Operation of the blunt bottom plate 23 on the lower end 28 of primary mandrel 20 consequently densities the aggregate vertically providing for the construction of a strong and stiff pier and the tapered mandrel creates radial outward forces which act on the aggregate to push it into the surrounding sidewalls of the cavity and further compact the surrounding earth E to densify the soil surrounding the pier to provide additional strength.

Figure 7:
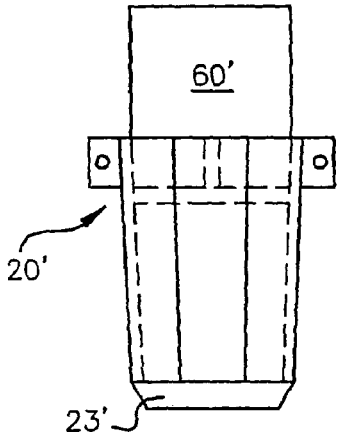
FIG. 7 is a front elevation of a secondary tamping mandrel used for tamping stone previously positioned near the top of a cavity formed by the mandrel of FIG. 1.
Figure 13:
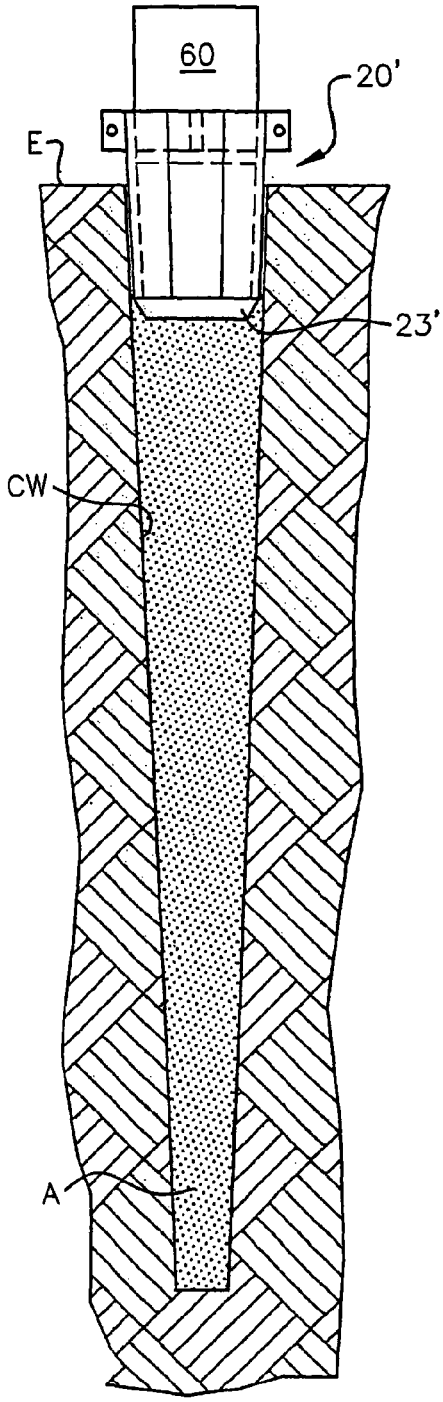
FIG. 13 is a vertical section showing completion of a pier by densifying the uppermost aggregate portion by the secondary tamping mandrel of FIG. 7.

The foregoing steps are repeated with deposit of additional layers of aggregate followed by subsequent densification of each layer by primary mandrel 20. When the top of the aggregate is near the upper portion of the pier as shown in FIG. 13 the optional larger diameter short length secondary tamping mandrel 20' of FIG. 7, which is powered by either an impact hydraulic hammer or a vibratory hammer, may optionally be employed for tamping and compressing the upper aggregate portion to complete formation of the pier. Large diameter tamping mandrel 20' has a lower end plate 23' which is preferably at least 75% of the diameter of the top of the pier being formed and is consequently substantially larger than blunt bottom plate 23 of the primary mandrel 20. Tamping mandrel 20' is supported by its drive and support plate 60' which is clamped in position on pile driving rig 26 which applies vertical static and vibratory force to plate 60' for densifying the aggregate in the upper 3 to 5 feet of the cavity previously formed with primary mandrel 20. Alternatively, a secondary rig with an impact hammer may be used to power the secondary mandrel.

Figure 30:
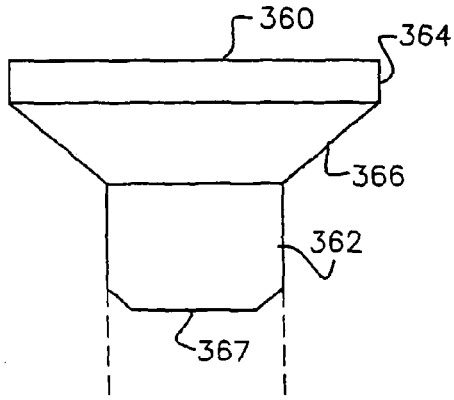
FIG. 30 illustrates a first alternative secondary tamping mandrel.

FIG. 30 illustrates another alternative secondary tamping mandrel 360 having a hollow shell, a smaller diameter bottom guide portion 362 and a top cylindrical portion 364 having a diameter exceeding the diameter of the upper end of primary mandrel 20. Smaller diameter portion 362 is connected to top portion 364 by an outwardly flared canted portion 366. The small diameter lower portion 362 has a transverse smaller lower end surface 367. The diameter of portion 362 is approximately the same as the diameter of the top of the cavity formed by the upper end of primary mandrel 20 which is shown by the dashed lines extending downwardly below mandrel 360.

Figure 31:
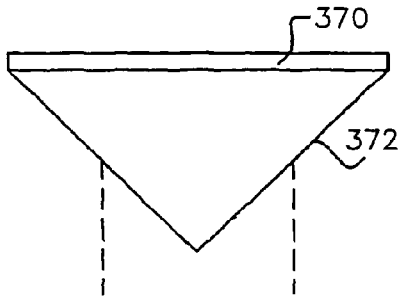
FIG. 31 illustrates a second alternative secondary tamping mandrel.

FIG. 31 illustrates a further secondary mandrel 370 having a conical surface 372 facing downwardly to engage the upper end of a previously formed cavity illustrated by the dashed lines in FIG. 31. This shape is advantageous in that it forms a larger diameter top-of-pier shape so as to provide resistance to soil heave and also provides increased confinement.

Secondary tamping mandrels 360 and 370 are used in the same manner as secondary tamping mandrel 20' as described above to form the top of the cavity in accordance with their specific shapes when such shapes conform with the structural requirements of particular piers to be constructed. If desired, telltales comprised of flat steel plates embedded in lower portions of piers and connected to upwardly extending steel bars which extend upwardly to the surface can be installed to provide an indication of any movement or bulging of the piers. Typically, the steel plates are installed on the bottom of the cavity and the bars extend either within the cavity or along the sidewalls of the cavity to the ground surface. Any movement of such steel plates will consequently result in observable displacement of the upper end of one or more of the steel bars so as to provide notice of bulging or other pier movement.

If desired, uplift anchors comprised of flat steel plates embedded in lower positions of the pier and connected to upwardly extending steel bars which extend upwardly to the surface can be installed to resist uplift loads.

Figure 14:
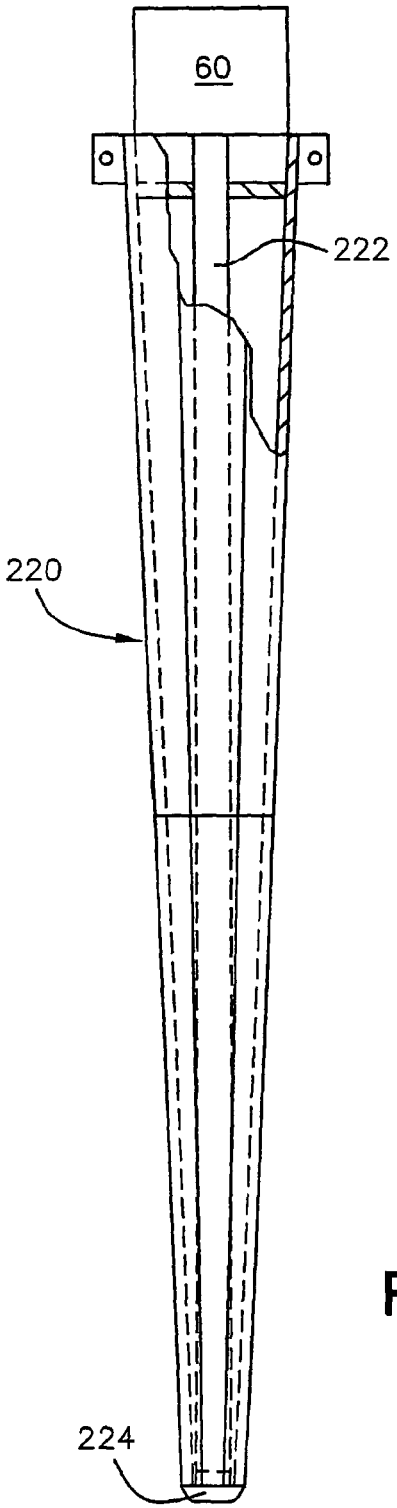
FIG. 14 is a front elevation of a modified mandrel embodiment which includes structure for injecting concrete or grout into aggregate in the cavity.
Figure 15:
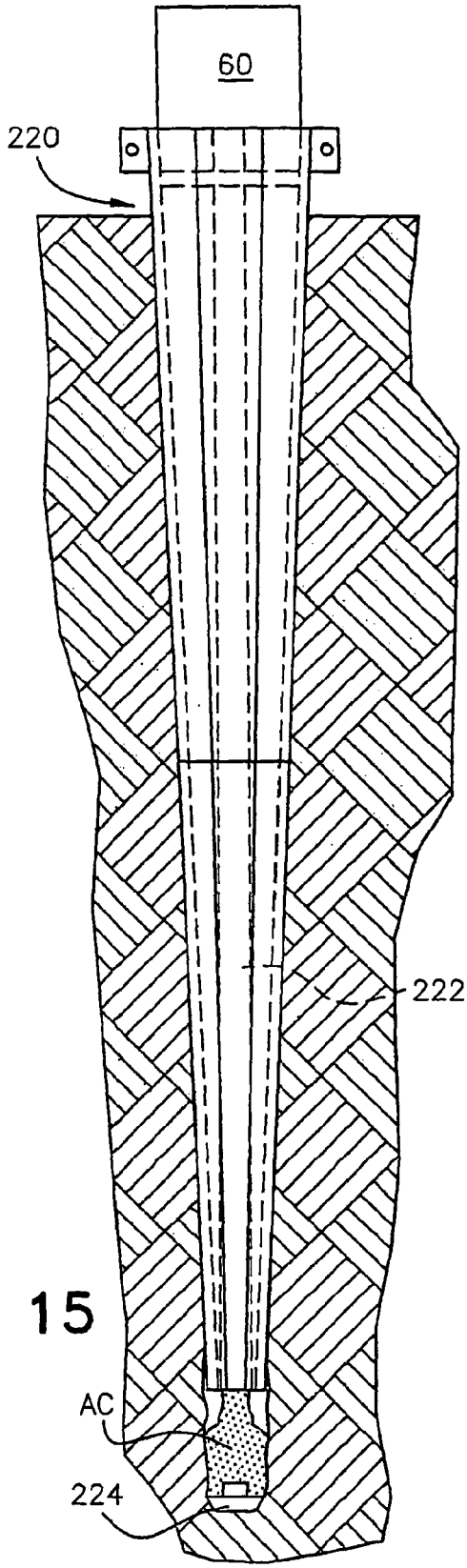
FIG. 15 is a vertical section illustrating concrete injection into aggregate in the cavity by the embodiment of FIG. 14.

A second embodiment of the present invention is illustrated in FIGS. 14 and 15 and is directed to a primary mandrel generally designated 220. Mandrel 220 is identical to the first embodiment mandrel 20, but differs by the additional inclusion of a concrete injection pipe 222 extending axially along the mandrel's length and having a sacrificial pop-off cap 224 at its lower end. In use, the mandrel 220 is employed for forming concrete foundations and similar structures. Construction of such foundations is effected by driving the mandrel 220 to the desired depth. Concrete or grout is then forced downwardly through injection pipe 222 to initially force the sacrificial cap 224 from the lower end of the mandrel and inject the concrete or grout AC. The concrete or grout AC is forced into the sidewalls of the cavity so as to increase load bearing capacity. The mandrel 220 is then slowly withdrawn from the cavity C while continuing to inject concrete or grout AC until mandrel 220 is fully retracted. Additionally, mandrel 220 can then be reinserted to force the concrete or grout AC further into the sidewalls of the cavity C so as to increase load capacity.

Referring, therefore, to FIGS. 32 through 39, there is illustrated two typical examples of implementation of the soil densification and stiffened pier forming procedures of the present invention.

Figure 32:
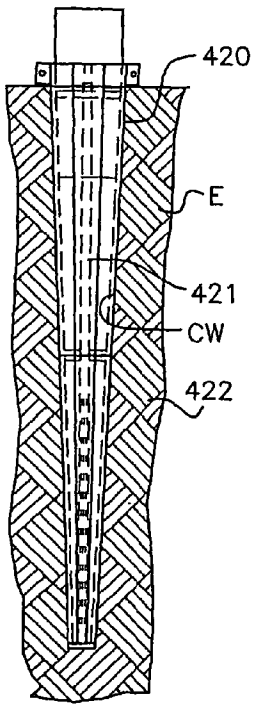
FIG. 32 is a diagrammatic view of a first step in the formation of a pier using the single stage method.
Figure 33:
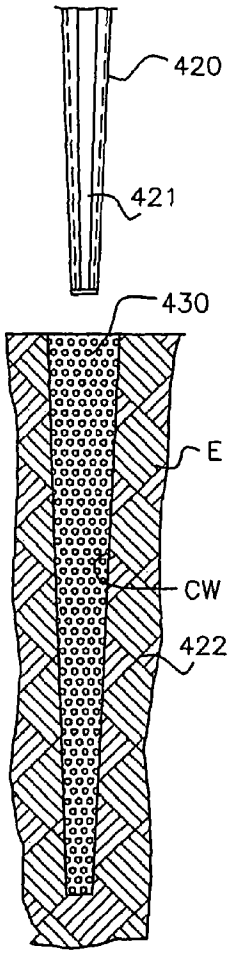
FIG. 33 is a diagrammatic view of a subsequent step to the step of FIG. 32 in formation of a pier using the single stage method.

As depicted in FIGS. 32 and 33, a passage or cavity having a cavity wall CW is formed in the earth by statically pushing, while optionally vibrating, a tapered probe 420 having an axial passageway 421 of sufficient size to permit the flow of aggregate 430 into soil matrix 422.

Upon completion of the cavity, the single stage method of forming the pier is begun by completely withdrawing probe or mandrel 420 from cavity 400 and raising it to the ground level or near ground level as shown in FIG. 33. The upper end of probe or mandrel 420 can be supplied with aggregate 430 and/or cementitious grout by means such as disclosed in patent application Ser. No. 10/728,405 of co-inventor Nathaniel S. Fox or by different conventional means. Aggregate 430 or aggregate with cementitious grout is then discharged down through probe or mandrel 420 to completely fill cavity 400. Aggregate 430 is discharged typically from the bottom of mandrel 420 through a clam valve, a sliding valve or other type of conventional mechanical opening device as the mandrel 420 is raised. Another alternative is for the bottom of mandrel 420 to remain open without a valve.

A further option is to discharge aggregate 430 by means of a plunger apparatus in mandrel 420 where a preset volume of aggregate 430 is discharged by pushing the plunger separately relative to mandrel 420.

Figure 34:
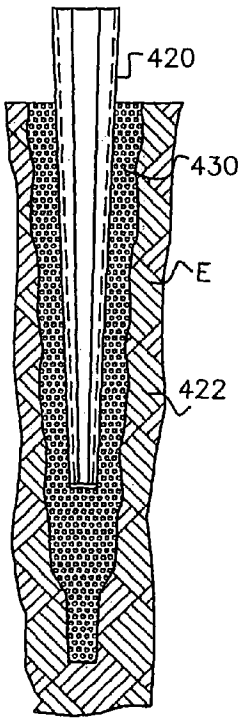
FIG. 34 is a diagrammatic view of a further step subsequent to the step of FIG. 33 using the single stage method.

Mandrel 420 is then re-introduced into the aggregate 430-filled cavity, and has displaced aggregate 430 laterally into the soil adjacent to cavity 400 as shown in FIG. 34.

Figure 35:
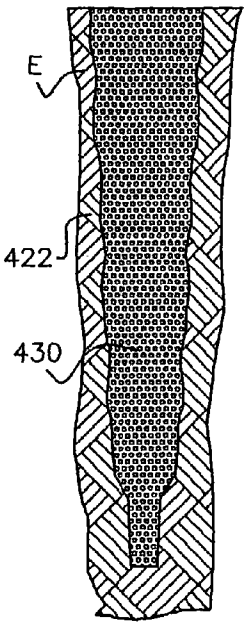
FIG. 35 is a diagrammatic view of the finished pier formed in accordance with the steps of FIGS. 32 through 34 using the single stage method.

Mandrel 420 may be withdrawn from the cavity 400 and aggregate 430 deposited to fill the void created by removal of mandrel 420. Mandrel 420 withdrawal, aggregate 430 deposit and mandrel 420 reintroduction steps may be repeated a plurality of times to create a larger effective pier diameter and greater soil densification of granular soils resulting in the outwardly bulging configuration as shown in FIG. 35.

Figure 36:
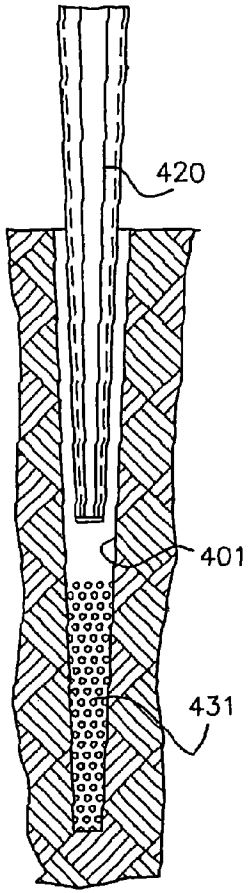
FIG. 36 comprises a diagrammatic view of a first step of the formation of a pier using the multiple stage method.

The multitude stage method of forming a pier, passage or cavity having a cavity wall CW is formed by pushing and optionally vibrating a tapered mandrel 420 into the ground in the manner illustrated in FIG. 32. Mandrel 420 is then partially raised while discharging aggregate 430 or aggregate 430 and cementitious grout 431 only into the bottom portion of cavity 400 as illustrated in FIG. 36.

Figure 37:
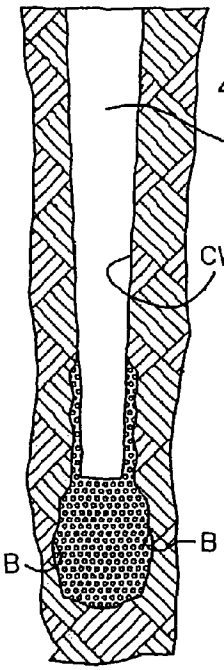
FIG. 37 is a diagrammatic view of a second step subsequent to the step of FIG. 36 in formation of a pier using the multiple stage method.
Figure 38:
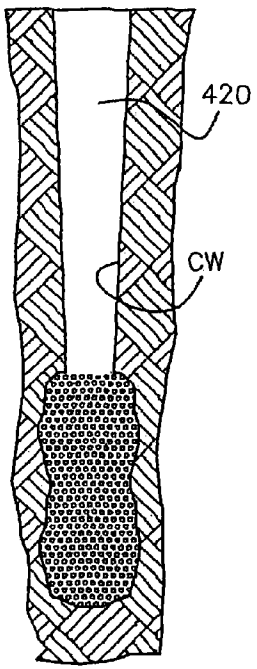
FIG. 38 is a diagrammatic view of a further step subsequent to the step of FIG. 37 using the multiple stage method.
Figure 39:
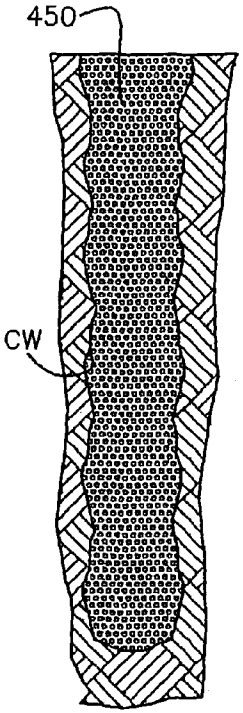
FIG. 39 is a diagrammatic view of the finished pier formed in accordance with the steps illustrated in FIGS. 36 through 37 using the multiple stage method.

Mandrel 420 is then re-introduced into the aggregate in the bottom end portion of the cavity to compact the aggregate 430 and grout 431 and displace a portion of aggregate 430 and grout 431 and surrounding soil to form bulges B as shown in FIG. 37 extending into the adjacent soil. Removal of mandrel 420 upwardly from the FIG. 37 position results in a void in the space previously occupied by mandrel 420. The next deposit fills in the void and a portion of the cavity 400 above the prior-created upper surface of aggregate 430. Aggregate 430 deposits and compaction are then repeated a plurality of times in like manner to provide completed pier 450 as illustrated in FIG. 39.

It is also possible to use the mandrel 220 to effect compaction grouting below the bottom of the mandrel 420. In this method, mandrel 420 is advanced to the design tip elevation and low-slump grout is pumped at high pressure from pipe 222. The compaction grout bulb is used to strengthen and stabilize soil at the tip of mandrel 420. The presence of mandrel 420 during compaction grouting operation also provides confinement for the grouting operation. After grouting, conventional concrete or grout may be pumped through pipe 222 to fill cavity 400 as mandrel 420 is extracted, or the cavity 400 may be filled with aggregate in the manner described above.

Still another embodiment of the method of forming a pier according to the present invention is illustrated in FIGS. 40-45. This embodiment of the method of forming an aggregate pier is especially suitable for use in soils that are incapable of forming a self-supporting cavity, such as the aforementioned cavity 400. That is, the present embodiment of the method is suitable for service in which the cavity wall CW is prone to collapse if unsupported. The method employs, sequentially, first mandrel 420 with the above-described sacrificial or removable pop-off cap 224 for aggregate 430 deposition, and second, a mandrel 420 with the above-described blunt bottom plate 23 for aggregate compaction and soil densification.

The method first employs the above-described mandrel 420 having an axial passageway 421 of sufficient size to permit the flow of aggregate into the soil matrix 422. At the lower end of mandrel 420, the axial passageway 421 is an open conduit. A sacrificial or removable pop-off cap 224 as described above initially covers the open end of axial passageway 421 at its lower end.

Figure 42:
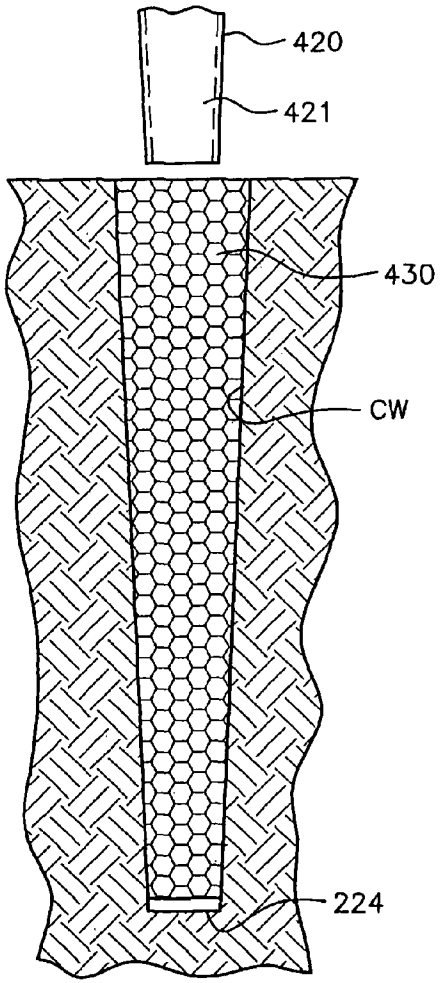
FIG. 42 is a diagrammatic view of a third step subsequent to the step of FIG. 41 in formation of the pier.
Figure 41:
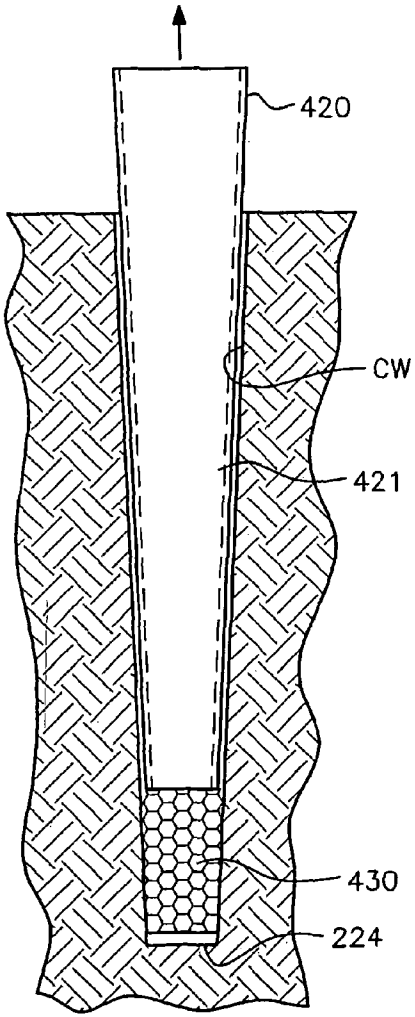
FIG. 41 is a diagrammatic view of a second step subsequent to the step of FIG. 40 in formation of the pier.
Figure 40:
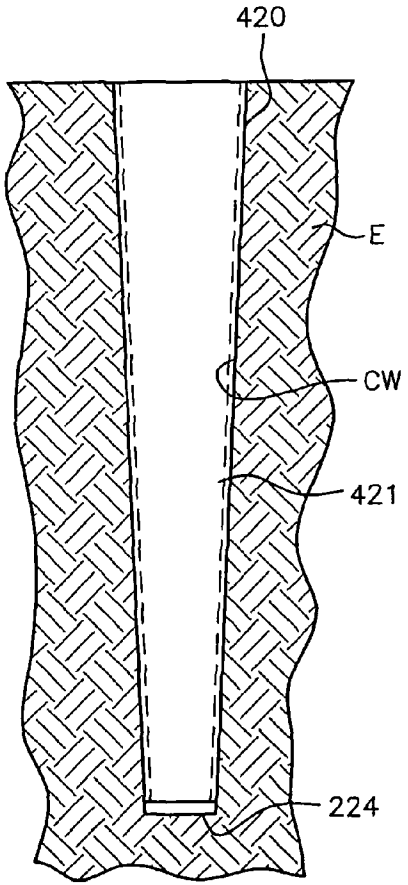
FIG. 40 is a diagrammatic view of a first step of the formation of a pier using another embodiment of the method according to the present invention.

As depicted in FIG. 40, a passage or cavity having a cavity wall CW is first formed in the earth by statically pushing, while optionally vibrating, mandrel 420. In a preferred embodiment of the method, the lower end of mandrel 420 is inserted to a design depth of approximately 10 to 20 feet. The presence of mandrel 420 supports the soil of unstable cavity wall CW. Next, mandrel 420 is filled with loose aggregate 430 and slowly raised so as to separate cap 224 from the lower end of axial passageway 421. Cap 224 remains at the lowermost end of the cavity 400. Aggregate 430 is deposited in the cavity 400 through the now exposed lower end of axial passageway 421. As shown in FIG. 41, the deposited aggregate 430 supports the lower portion of cavity wall CW that is no longer supported by the partially raised mandrel 420. The mandrel 420 continues to be slowly raised until it is at ground level or near ground level as shown in FIG. 42. The presence of aggregate 430 now stabilizes the filled cavity by supporting unstable cavity wall CW for the entire height of the wall. According to one preferred embodiment of the method, a plurality of the aggregate 430-filled cavities 400 is formed before effecting the remaining pier forming steps described below.

Figure 45:
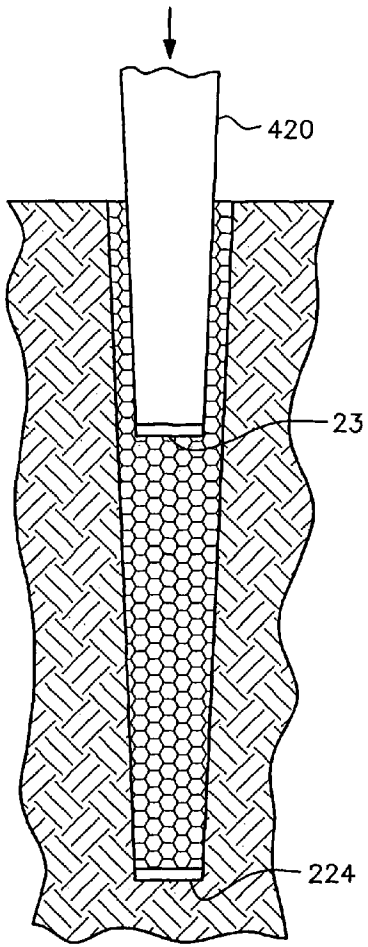
FIG. 45 is a diagrammatic view of a sixth step subsequent to the step of FIG. 44 in formation of the pier.
Figure 44:
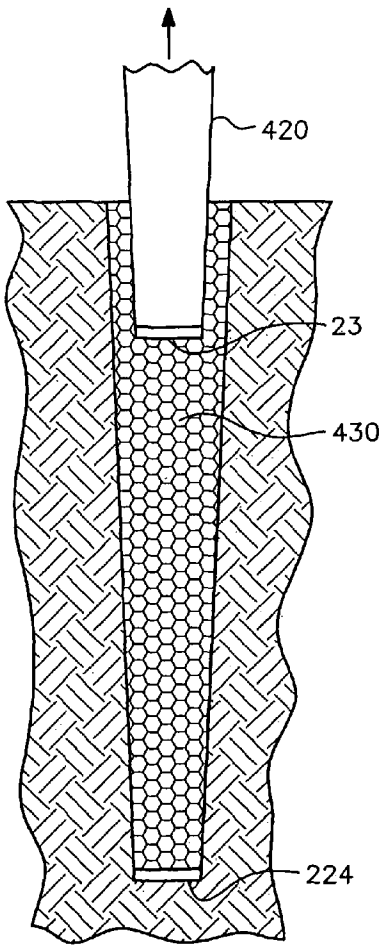
FIG. 44 is a diagrammatic view of a fifth step subsequent to the step of FIG. 43 in formation of the pier.
Figure 43:
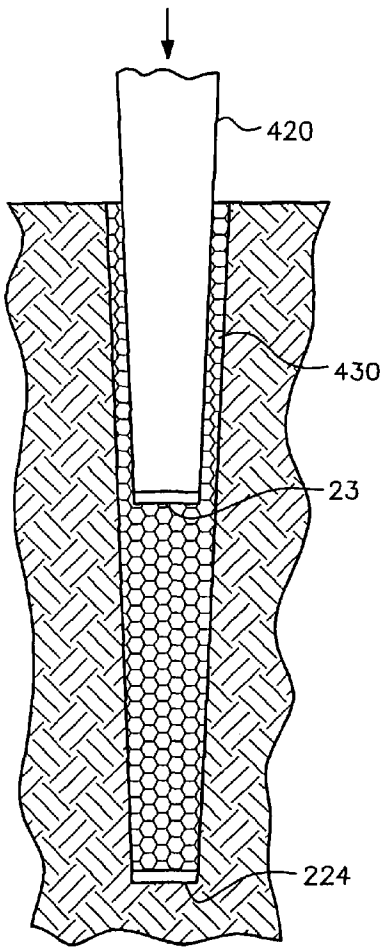
FIG. 43 is a diagrammatic view of a fourth step subsequent to the step of FIG. 42 in formation of the pier.

Next, as shown in FIG. 43, mandrel 420 with the blunt bottom plate 23 is used to compact the deposited aggregate 430 and to densify the surrounding soil. In a preferred embodiment, the deposited aggregate 430 is compacted to a depth of approximately 5 to 15 feet. Then, mandrel 420 is partially or fully withdrawn to the upper end of the cavity 400 as shown in FIG. 44, and a quantity of loose aggregate 430 is deposited into the bottom end of the partially-filled cavity 400. As shown in FIG. 45, mandrel 420 is then reintroduced into cavity 400 to compact the previously deposited aggregate 430 and to densify the soil. The foregoing steps using mandrel 420 with blunt bottom plate 23 are repeated sequentially, with deposition of additional layers of aggregate 430 followed by subsequent densification of each deposited layer.

According to one embodiment of the above-described method, the mandrel 420 that is used to compact the deposited aggregate 430 and to densify the surrounding soil (see FIGS. 43-45) is the same mandrel 420 that is used to form the cavity 400 (see FIGS. 40-42), but having the open lower end of axial passageway 421 subsequently covered by the blunt bottom plate 23. That is, once mandrel 420 is raised to the position depicted in FIG. 42, the method includes the step of attaching the blunt bottom plate 23 to cover the lower end of axial passageway 421.

According to an alternative embodiment of the method, the mandrel 420 that is used to compact the deposited aggregate 430 and to densify the surrounding soil is a different mandrel 420 than that which is used to form the cavity 400. According to this embodiment of the method, once mandrel 420 is raised to the position depicted in FIG. 42, the method includes the step of changing out mandrel 420 for a mandrel 420 that has a fixed blunt bottom plate 23.

According to still another embodiment of the method, the mandrel 420 that is used to form the cavity has a mechanical opening device, such as, for example, a hinged bottom cap, rather than the above-described sacrificial pop-off cap 224. According to this embodiment of the method, once mandrel 420 is slowly raised, the hinged cap is configured to swing away from the bottom of the mandrel so as to expose the lower end of axial passageway 421.

Figure 47:
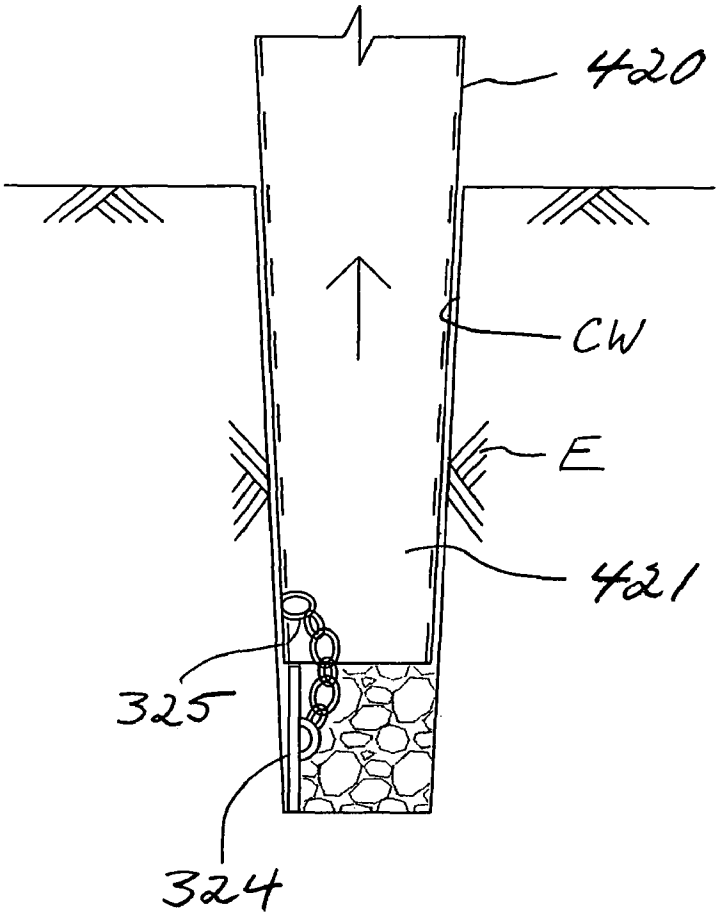
FIG. 47 is a diagrammatic view of the mandrel with the removable and recoverable cap illustrated in FIG. 46 as the mandrel is being withdrawn from a formed cavity.
Figure 46:
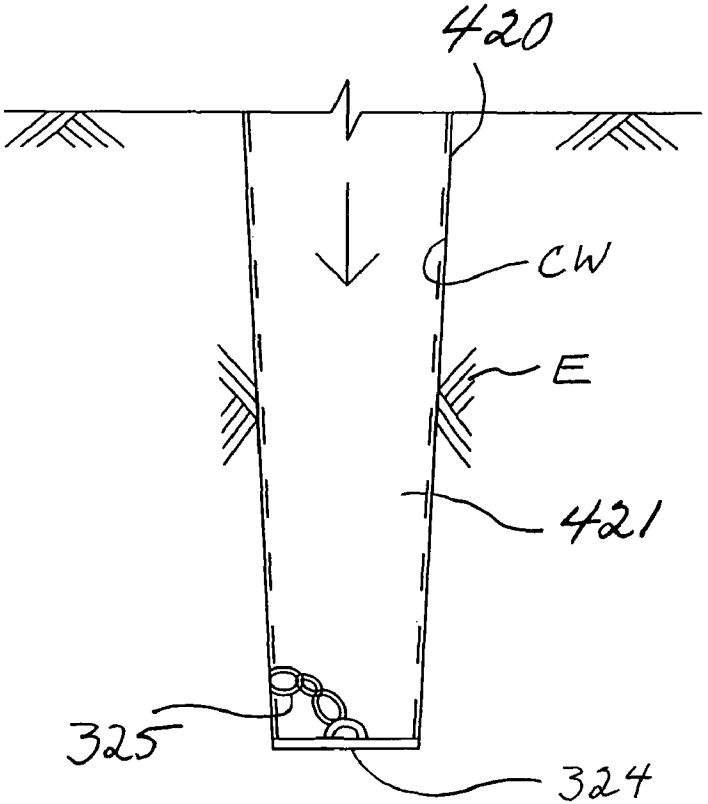
FIG. 46 is a diagrammatic view of another embodiment of the mandrel according to the present invention in which a bottom cap is both removable and recoverable.

According to still another embodiment of the apparatus and method, the mandrel 420 that is used to form the cavity 400 has a removable and recoverable cap 324, i.e., a tethered cap, rather than the above-described sacrificial pop-off cap 224 or hinged cap. The removable and recoverable cap 324, therefore, is reusable. According to this embodiment of the invention and as illustrated in FIGS. 46 and 47, the removable and recoverable cap 324 is attached to the mandrel 420 by a tether 325. According to a preferred embodiment of the invention, the tether 325 is a flexible securing device such as a chain or a cable. The tether can, however, be another type of device as long as it both securely attaches the cap 324 to the mandrel 420 and is of sufficient structural integrity to withstand the environment of the pier formation.

As shown in FIG. 47, once mandrel 420 is slowly raised, the removable and recoverable cap 324 is configured to separate from the bottom of the mandrel 420 so as to expose the lower end of axial passageway 421. Because the separated cap 324 remains attached to the mandrel 420 by the tether 325, the separated cap 324 is withdrawn from the cavity 400 along with the mandrel 420. The recovered cap 324 can then be re-attached to the mandrel 420 for subsequent reuse.

Figure 23:
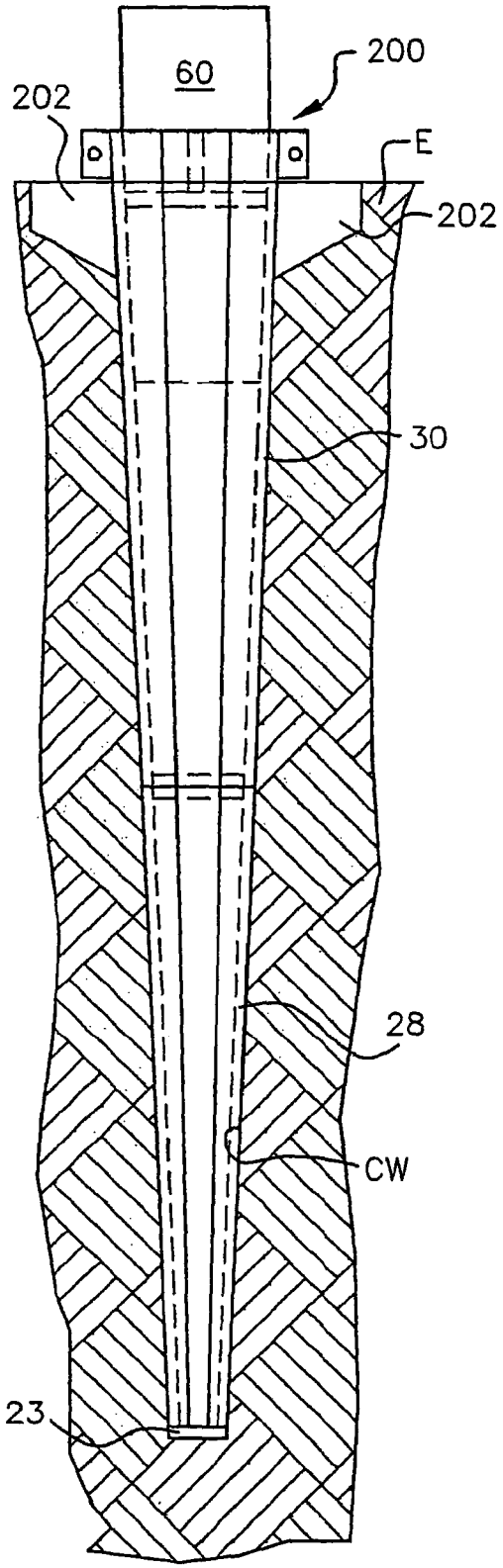
FIG. 23 is a vertical section of the earth illustrating completion of a pier receiving cavity by a third embodiment tapered mandrel having a radially extending flange at its upper end.

FIG. 23 illustrates a modified mandrel 200, which is similar to mandrel 20, but is provided with an optional peripheral flange 202 at its upper end. Flange 202 is circular and extends completely around the top of the mandrel. It thus acts to inhibit upward movement of surficial soil during mandrel 200 penetration to the fully embedded position shown in FIG. 23. During manual penetration of mandrels not having flanges 202, the surficial soil may be displaced laterally and may also heave upwardly. Such lateral displacement and upward heaving is a particularly acute problem with cohesive soils. During penetration, the radial flange 202 engages the heaving soil and forces it downwardly so as to compact the soil and provide additional confinement to the upper portions of the tapered mandrel 200 shaft so as to reduce or eliminate heaving.

Flange 202 also acts to provide a larger cavity at the top of the pier which can be filled with aggregate to create a larger top-of-pier diameter which is cost advantageous when the pier is to support thin building floor slabs. Such cost benefits result from reducing the floor slab span between piers so that the construction costs of the slab can be reduced. While an alternative for reducing the pier-to-pier floor slab span would be to make the entire length of the pier of greater diameter from top to bottom, such procedure would be much more costly than having a top-of-pier large diameter portion.

Figure 24:
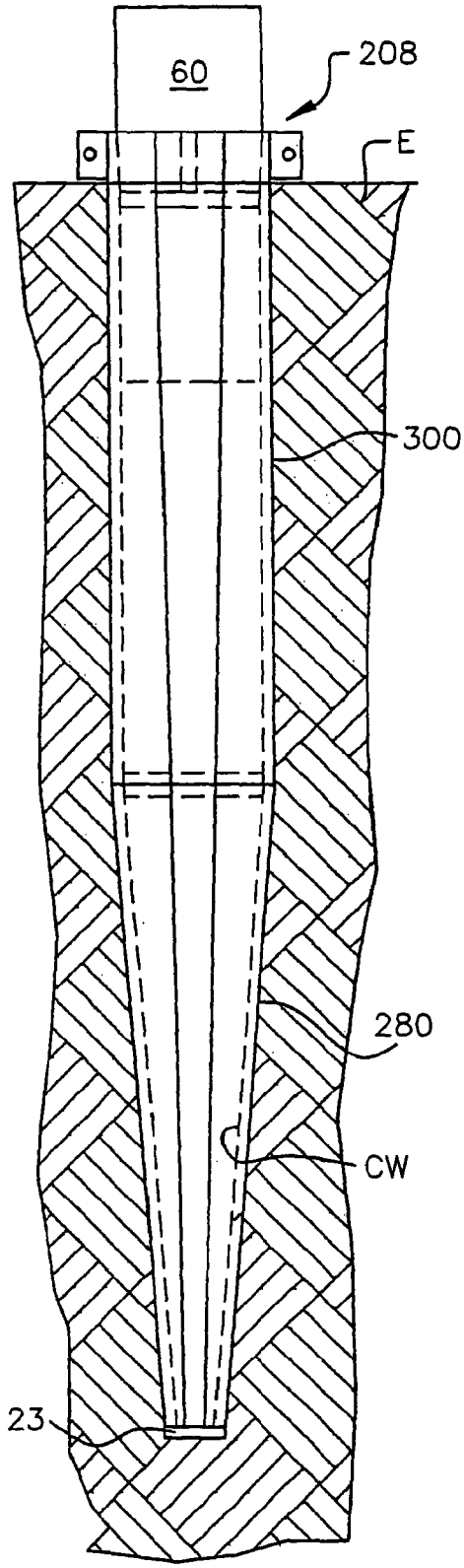
FIG. 24 is a vertical section of the earth illustrating completion of a pier receiving cavity by a further embodiment mandrel having a straight untapered sided top portion and a tapered lower portion.

FIG. 24 illustrates a further mandrel embodiment 208 formed with a tapered lower section 280 and a straight-sided untapered upper section 300. The straight/tapered mandrel 208 is advantageous in the stabilization of soil profiles that consist of cohesive soils in the upper portion of the profile and granular soils in the lower portion of the profile. Tapered mandrel 208 is advantageous for keeping the granular soils stabilized during construction. However, the tapered shape is not needed for stability of the upper level cohesive soils. An advantage of the straight-sided untapered upper section 300 is that a fairly narrow cavity may be constructed through the cohesive soils thus reducing the amount of energy required for installation relative to the amount of energy required by a mandrel that is tapered from bottom to top.

Figure 25:
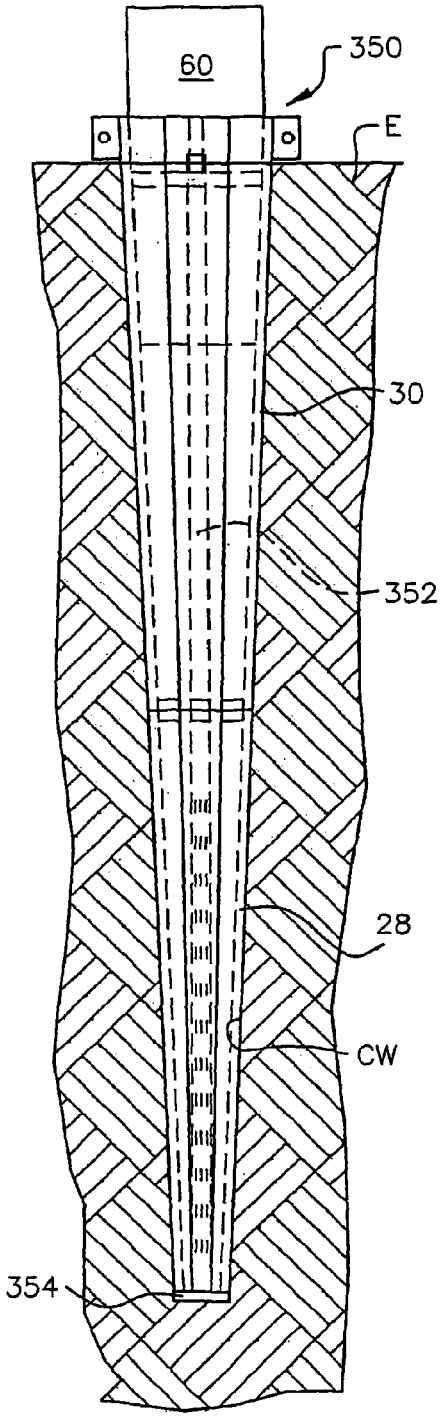
FIG. 25 illustrates another tapered mandrel having an internal perforated pipe axially positioned therein.

FIG. 25 illustrates a mandrel 350 similar to the mandrel of FIG. 1, but which has been modified to include a hollow core extending axially along the length of the mandrel with a perforated pipe 352 being loosely positioned within the core. The lower end of pipe 352 is connected to a bottom plate 354 that covers the annulus of the bottom of the mandrel 350.

Figures 26, 27, 28, 29:
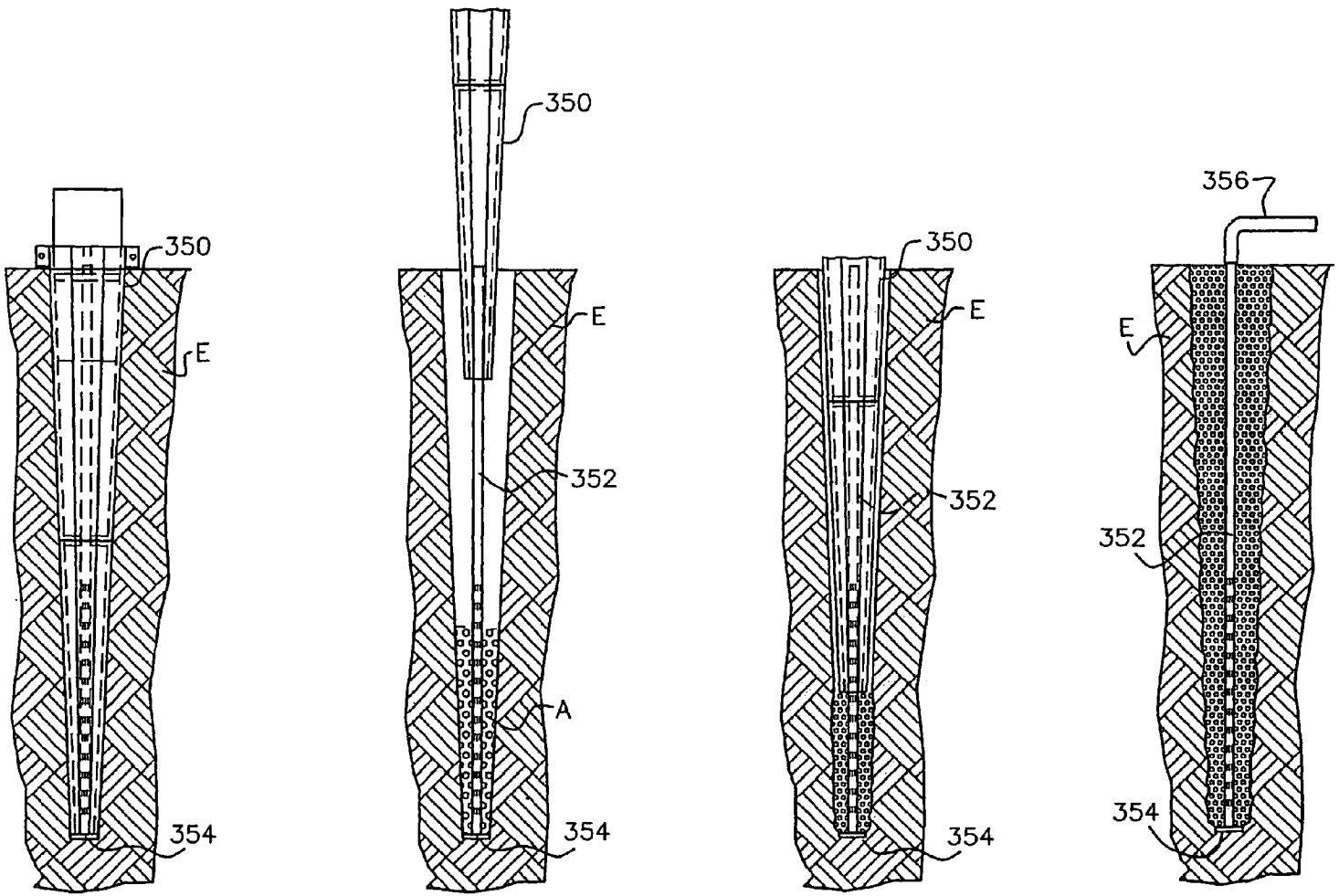
FIG. 26 illustrates a mandrel following insertion in the earth for the initiation of forming a pier.
FIG. 27 illustrates the position of the components effected subsequent to the FIG. 26 position and in which the mandrel is elevated to permit deposit of aggregate in the cavity.
FIG. 28 illustrates the position subsequent to the position illustrated in FIG. 27 in which the mandrel has been reinserted to compact aggregate previously deposited in the cavity as shown in FIG. 27.
FIG. 29 illustrates the condition assumed subsequent to removal of the mandrel from the cavity as shown in FIG. 28 with the perforated pipe remaining in the cavity for enabling post-grouting of the aggregate.

The first step in the use of mandrel 350 is insertion of mandrel 350 into the earth E to the position shown in FIG. 26. Mandrel 350 is then lifted upwardly to an elevated position as shown in FIG. 27; however, perforated pipe 352 is not lifted upwardly with mandrel 350 but remains in the cavity. Aggregate A is deposited in the lower end of the cavity and the mandrel 350 is then re-inserted downwardly to compact aggregate A as shown in FIG. 28. Sequential depositing of aggregate and compaction are continued until the aggregate fills the pier as shown in FIG. 29 with the perforated pipe 352 remaining in the aggregate A that has previously been densified by mandrel 350. The pier may then be post-grouted by connecting the top of the perforated pipe 352 to a grout hose 356 into which grout is pumped to flow downwardly through perforated pipe 352 and exit from the perforations 357 in the lower end of the perforated pipe 352. In this way, specific areas of the pier may be post-grouted quickly and efficiently. Such post-grouting is particularly advantageous for soils such as peat that are susceptible to pier bulging when placed under load. It should be understood that in all instances where grout is used, the grout may be enhanced by the addition of additives and agents such as chemicals or fillers, recycled concrete or slag for strengthening, accelerators for controlling the rate at which solidification will occur or other materials deemed desirable for a particular project.

An alternate method of construction is illustrated in FIGS. 32 to 39. The tapered probe or mandrel assembly is pushed into the ground to enable simultaneous densification and improvement of soil adjacent the cavity or passage to permit creation of a stiffened pier or pile within the passage in the densified soil. The alternate process contemplates discharge of aggregate or aggregate with cementitious grout into the cavity formed as the probe is raised from the bottom of the formed cavity and then pushing the probe back into the aggregate-filled (or aggregate-with-grout-filled) passage to densify and displace the aggregate into the adjacent soil. This process may be performed as a single stage process, wherein the probe is raised the full length of the cavity and then re-introduced into aggregate that has been discharged into the cavity, or it may be performed as a multiple stage process, wherein the probe is raised only a portion of the cavity length, and then re-introduced and pushed into the aggregate to compact the aggregate and displace it into the adjacent soil in a plurality of steps. Aggregate may be discharged from the bottom of the probe from an opening at the bottom created by a clam-valve apparatus, a sliding valve, or other mechanical or hydraulic means of opening and then closing the bottom of the probe apparatus. An alternative is to leave the opening of the bottom of the probe open with no closing and opening valves. Aggregate may also be discharged by being injected into the cavity by a plunger-type apparatus which would essentially dictate the volume of aggregate being discharged.

For all of the embodiments described above, the aggregate may be aggregate of various size ranges, may be aggregate alone or may be aggregate with the addition of a cementitious grout. The grout may include numerous additives and agents such as chemicals or fillers for strengthening, accelerators for controlling the rate at which the fluid material will solidify and other additives.

For all of the embodiments described above, the bottom of the tapered probe may be flat, or it may be flat with beveled sides with a taper greater than the taper of the probe sides, or it may have another shape such as conical or convex semi-spherical.

Figure 19:
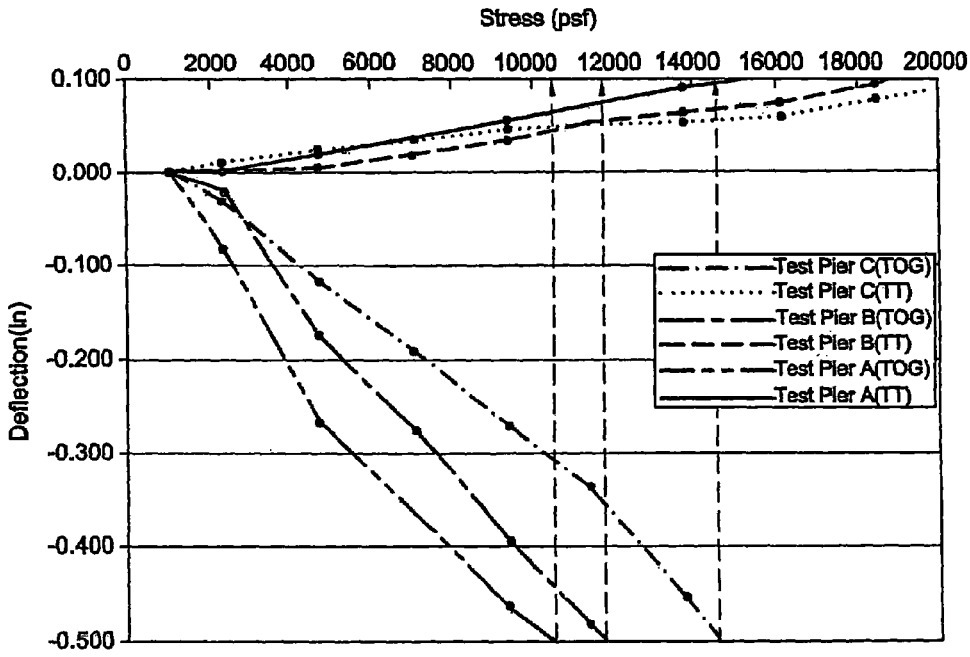
FIG. 19 is a graphic illustration of stress (psf) and resultant deflection measure for three test piers formed in accordance with the present invention, as measured at the tops of the piers and at lower pier areas by telltales.

Field tests reflected in FIGS. 19, 20, 21 and 22 indicate the stiffness of the pier when load-tested and indicate the increase in soil density that is achieved by pier construction. More specifically, FIG. 19 is a graphic illustration of stress applied to and resultant deflection of test piers "A", "B" and "C" which were respectively constructed by specific different, but similar, construction procedures.

Specifically, test pier "A" was constructed by using a single blunt-ended tapered primary mandrel 20 having a taper angle of 5 degrees to form the cavity and then to densify all of the aggregate forming the entire pier up to the ground surface (grade). This means that all of the aggregate in the entire pier was compacted using the blunt bottom plate 23 that has a small cross-sectional area compared to the cross-sectional area of the top pier and mandrel portions. The mandrel was driven downwardly by constant static pressure and concurrent vertical vibration supplied by a vibratory piling hammer using rotating weights driven at approximately 2,400 revolutions per minute to create vertical high frequency (up and down) vibratory energy applied to compact and densify each lift of aggregate.

Test pier "B" was constructed using the same drive means used for pier "A" to drive blunt-ended tapered primary mandrel 20 to form a cavity and densify aggregate from the bottom of the cavity up to a position approximately four (4) feet below the surface of the earth. The remaining portions of the pier above the four (4) foot depth were constructed upwardly to the surface of the earth using a widened blunt-end tamping mandrel 20' of FIG. 7 which was driven by static force and the same vibratory piling hammer used for pier "A". The tamping mandrel 20' had a cross-sectional area approximating the cross-sectional area of the top of the pier which is substantially greater in area than the blunt bottom plate 23 of tapered primary mandrel 20.

Test pier "C" was constructed using the blunt-end tapered primary mandrel 20 to form a cavity and densify aggregate upward to a location four (4) feet below grade in the same manner as pier "B". However, the upper pier portion extending upwardly from the position four (4) feet below grade was constructed using a conventional beveled tamper such as tamper 10 disclosed in U.S. Pat. No. 5,249,892. The beveled tamper was driven by a conventional hydraulic impact hammer applying relatively low frequency blows at approximately 500 blows per minute applied concurrently with static downward pressure. The conventional hydraulic impact hammer was part of excavation-mounted rig 26 and employed a ram lifted hydraulically and then smashed downwardly internally on a striker plate to drive the beveled tamper downwardly.

FIG. 19 illustrates the results of load tests of piers "A", "B" and "C" which were each tested by placing a concrete cap over the full diameter of the pier at ground level. Loads were applied to the pier by pushing down on the concrete caps. The stress applied to the pier was calculated by dividing the applied load in pounds by cross-sectional area of the top of the pier in square feet. Readings TOG reflect deflection readings taken at the tops of the piers and readings TT reflect below grade telltale deflection for each of the three piers.

Figure 20:
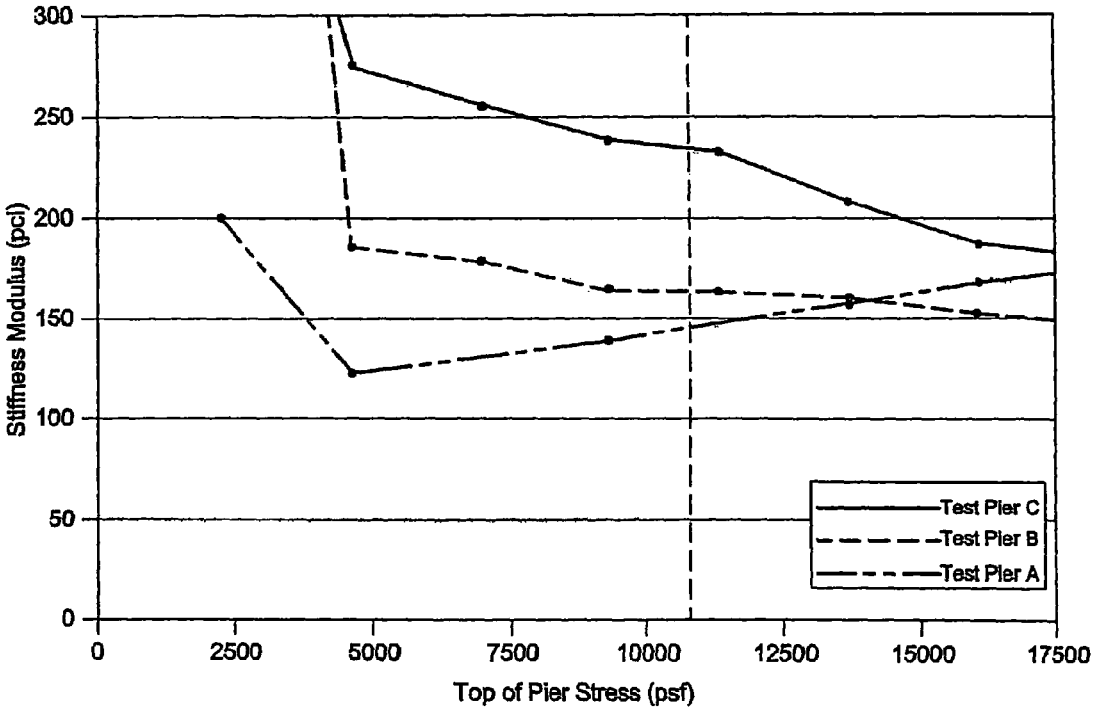
FIG. 20 is a plot of the stiffness modulus (ratio of applied stress to deflection) for increasing values of pier stress values for the three test piers of FIG. 19.

The construction procedures used in forming pier "A" resulted in a pier with excellent load carrying capacity and stiffness (FIG. 20). The improved results flow from the unique construction procedures which resulted in significantly strengthening and stiffening of the matrix soil in which the piers were constructed and from the blunt end of the primary mandrel used to achieve compaction.

Pier "B" was constructed by use of the wider tamping mandrel 20' to compact the top portion of the pier and the strength and stiffness of the pier was somewhat better than for pier "A". Such strength increase is demonstrated by FIG. 19 in which equivalent deflections for test piers "A" and "B" reveal that test pier "B" allows for greater applied stresses at the same deflection level. This means that test pier "B" can support greater loads than test pier "A". In other words, fewer "B" piers than "A" piers could be used to support a given load while achieving the same performance. Alternatively, "B" piers will result in less settlement than "A" piers at the equivalent applied stress.

The procedures used in constructing test pier "C" resulted in the construction of a pier having even greater strength and stiffness than piers "A" and "B".

Figure 21:
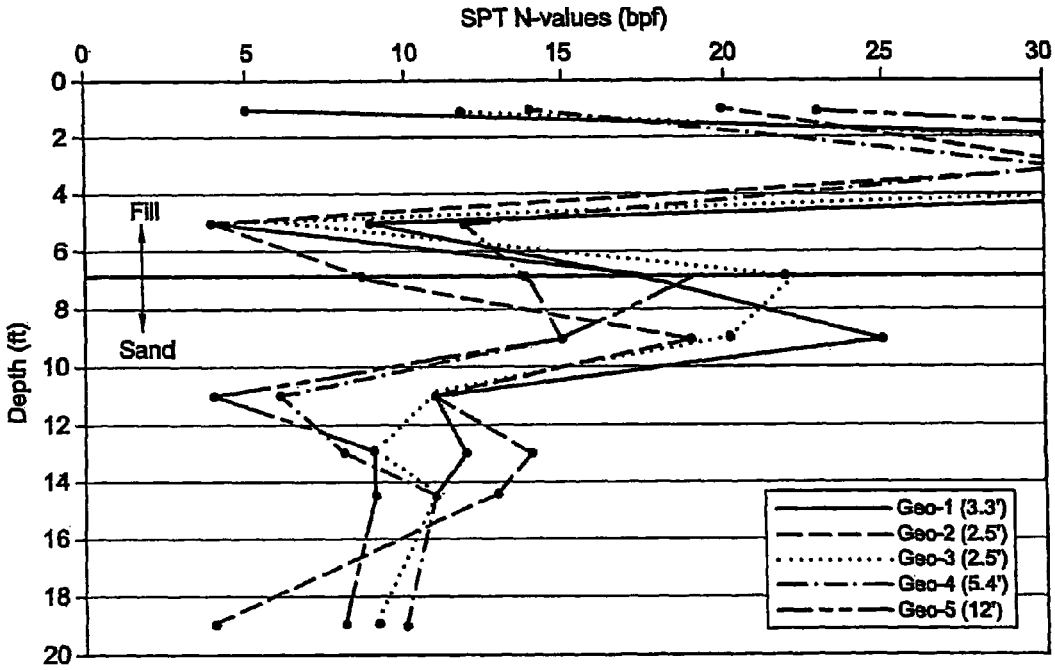
FIG. 21 illustrates SPT-N values for different distances from piers constructed according to the present invention.

The plots of FIG. 21 reveal that SPT-N values in the soil at various distances from the piers constructed in accordance with the present invention were enhanced by the forces exerted on the matrix soils during installation of the piers. The Standard Penetration Tests were performed within soil borings by driving a two-inch outside diameter steel tube (called a "spoon") 18 inches into the ground using a 140 pound hammer with a 30 inch drop. The number of driving blows for each six-inch increment are counted, and the N-value is the sum of the last two recordings (or the number of blows required to drive the last 12 inches of the spoon). Low N-values indicate weak and soft soil. High N-values indicate strong and dense soil. The plot shown in FIG. 21 reveals that increased N-values are found near the installed piers and that the installation increases the density of matrix soils (existing soils in place prior to pier installation) which results in an increase in penetration resistance (N-value) and soil stability. These results are significant because they show that the pier installations, not only result in strong and stiff piers, but also they improve the ground around the piers so as to enhance their function of limiting settlement below structures supported by the piers.

Figure 22:
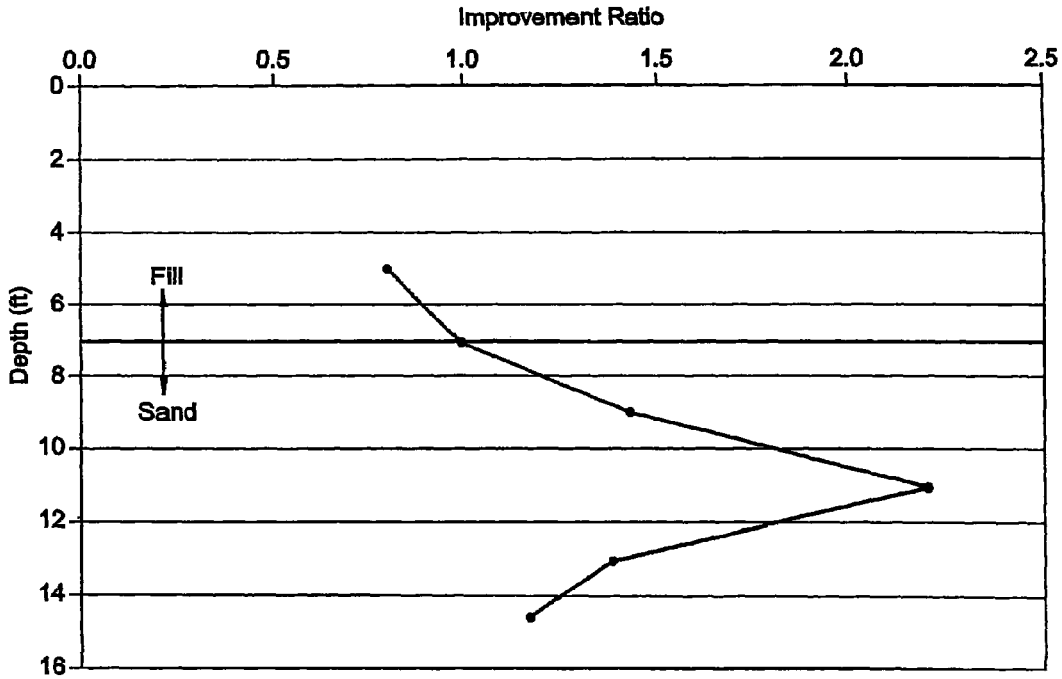
FIG. 22 illustrates the ratio of SPT-N values for piers constructed using the present invention to the SPT-N values in the soil prior to construction of the piers.

FIG. 22 comprises a plot of improvement ratios to depth. The improvement ratio is a ratio of SPT-N values measured after the piers are installed to the SPT-N values of the matrix soil before the piers are installed. The higher the improvement ratio, the greater the positive effect of the pier installation on the soils being treated. This plot clearly shows improvement ratios exceeding 1.0 which evidence the beneficial effects of pier installation on the matrix soil which adds to the pier's effectiveness at reducing the magnitude of pier settlement.

The above described apparatus and methods provide a number of advantages. One such advantage is enhanced stability of the sidewalls of the cavity after the mandrel penetration forming the cavity. Unlike previous methods of construction of stone columns, the continuously tapered mandrel provides stability in both stable soil and soil that is otherwise susceptible to collapse. It is consequently possible for a simple, fast and economical introduction of aggregate into the cavity to be accomplished immediately after the mandrel is withdrawn.

A further advantage of the cavity sidewall having enhanced stability is that it permits the efficient inspection of the cavity and the placement of the stone as compared to prior art procedures in which the cavity wall and the lower end of the cavity are not visible due to the need for wall retaining means.

Another advantage of the present invention resides in the fact that the enhanced stability of the sidewalls permits installation of telltales with load test piers. Such telltales are an important part of load testing because they provide pier installers with the ability to ascertain deformations at both the top and bottom of the pier during testing.

A further advantage of the enhanced stability of the sidewalls is that it permits the installation of uplift anchors at the bottom of the piers. Such anchors are used as permanent tie-downs for a variety of structures. The previously known procedures do not facilitate the installation of such uplift anchors.

Yet another advantage of the enhanced sidewall stability provided by the present invention is that it permits the introduction of large aggregate and heterogeneous durable angular materials within the pier. Pier backfill may consist of cobbles, large stone, bricks, recycled concrete columns, soil stabilized with admixtures and other types of durable backfill. Portions of the pier maybe filled with low-slump concrete, and the backfill materials are not limited to the shape of a pipe used to feed the backfill to the bottom of the cavity.

The continuously tapered shape of the cavity is the optimal shape for achieving resistance to pier loads that would otherwise cause the piers to bulge outwardly and collapse. This is true because conventional cylindrical stone columns are most susceptible to bulging at the tops of the columns where the confining stresses of the surrounding cavity wall are lowest. At greater depths, confining stresses are higher so as to inhibit the propensity of the columns to bulge. The construction of the pier with the largest cross-sectional area at the top and the smallest cross-sectional area at the bottom, as provided by the present invention, results in a column with the greatest resistance to bulging at the top and least resistance to bulging at the bottom. The resistance profile, combined with the matrix soil confining stress profile, allows the pier to have a uniform resistance to bulging with depth thus optimizing the volume of aggregate used in construction.

The shape of the blunt-bottom mandrel also provides a more efficient means for compacting the aggregate in the portions of the pier. Such effectiveness of compaction is much greater than for the prior known mandrels having small or pointed lower ends. The resultant pier construction will consequently have greater vertical load support capability.

The use of vertical vibration or impact energy is much more effective than conventional horizontally applied vibration energy for compacting aggregate in the pier. Vertically applied energy increases the density of the aggregate and increases the load carrying capacity of the pier in comparison to stone columns constructed by prior known conventional methods.

The vertical vibration energy applied to the mandrel also increases the density of matrix granular soil and densities the surrounding soil during installation and also during construction of the pier. The densification of the matrix soil during initial penetration and during subsequent densification of aggregate lifts the load carrying capacity of aggregate piers and increases the stiffness of the matrix soil surrounding the pier. This increased matrix soil stiffness increases support capability of the pier. The increase in soil density is shown by the increase in post-installation Standard Penetration Test N-Values for soil sampled between, adjacent to and far away from the installed pier.

The vertically applied energy develops greater penetration capability than conventional vibration with horizontal oscillators.

The optional use of the larger, secondary mandrel for compaction at the top of the cavity provides for a great increase in the stiffness of the pier in comparison to densifying the entire pier with the tapered conical mandrel used to create the cavity.

The installation process also allows for an efficient means of installing concrete foundation elements, and also allows the further densification of the concrete by pushing the mandrel back down into the grout/concrete filled cavity.

It is also possible to form piers by the inventive method which may serve as drainage elements in cohesive soils if open-graded aggregate is used in the cavity. The great ease in placing aggregate in the cavity allows for ease in changing the type of aggregate used at various depths of the pier so as to permit optimization of the drainage and filtration features of the aggregate.

Another advantage of the tapered sides is to ease the force necessary to raise the probe and reduce the possibility of the probe becoming "stuck" in the ground.

Quality control is enhanced because a measured amount of stone is applied to each lift. A method of continuously measuring aggregate quantity usage in pier using sensors to measure and a computer to record elevation of top of aggregate pile is possible.

Another advantage is that great flexibility in installation procedures is enabled by altering the number of repetitions that are made of raising with discharging of aggregate and pushing the probe back into the aggregate to densify and pre-stress the adjacent soil following which repeating the procedure at the same approximate elevation by raising and discharging aggregate into the cavity formed and pushing the probe back into the aggregate enables a pier of greater the effective diameter, greater the lateral soil stressing especially in granular soils and the greater the densification of adjacent soil.

Use of the tapered mandrel also results in a significant change to the in-site stress field surrounding the pier. Advanced numerical analyses indicate that the vertical stresses in the matrix soil are also increased by approximately 10 percent during mandrel penetration allowing for further compaction of the soil. These stress field changes are significant for two reasons. First, in fine-grain cohesive soil, the cavity expansion results in the formation of radial tension cracks in the soil surrounding the pier. These cracks serve as drainage galleries, increasing the composite permeability of the matrix soil. Secondly, in granular soil, the increase in vertical stress allows for a densification of the soil immediately surrounding the mandrel. This densification is a process that provides for enhanced cavity stability during mandrel lifting, even in soil subject to caving.

Modifications and variations of the above-described embodiments of the present invention are possible by those skilled in the art in light of the above teachings. For example, the mandrel could be formed using only two half-shells, each of which would extend from the lower end to the upper end of the mandrel. Also, it would be possible to provide a mandrel having a cross-section other than octagonal; however, the octagonal cross-section may be superior in terms of fabrication costs and operational efficiency. It is therefore to be understood that, within the scope of the appended claims and their equivalents, the invention may be practiced otherwise than as specifically described and the scope of the claims defines the invention coverage.

What is claimed is:

1. A method of forming an aggregate pier comprising the steps of:

(a) driving downwardly into pier site soil a tapered mandrel having an open lower end initially covered by a cap to form a downwardly tapered cavity to a desired depth for said aggregate pier while supporting a sidewall of the cavity;

(b) moving the tapered mandrel upwardly to a top of said cavity so as to separate said cap from said open end of the mandrel and withdraw said cap while delivering loose aggregate through said open end of the mandrel and depositing said delivered aggregate to the cavity so as to support said sidewall below said upwardly moved mandrel;

(c) driving downwardly into said deposited aggregate a tapered mandrel having a blunt lower end surface so that said blunt lower end of the mandrel compacts said deposited aggregate and densities said soil;

(d) moving said tapered mandrel having the blunt lower end surface upwardly from said compacted aggregate and depositing additional loose aggregate in said cavity; and (e) repeating said steps (c) and (d) until a pier component of a desired height is formed.

2. The method according to claim 1, wherein said depth of the pier is approximately 10 to 20 feet.

3. The method according to claim 1, wherein said step (c) compacts said deposited aggregate to a depth of approximately 5 to 15 feet.

4. The method according to claim 1, further comprising, after said step (b) of moving the tapered mandrel upwardly to the top of the cavity, a step of affixing the blunt lower end surface to the mandrel.

5. The method according to claim 1, further comprising, after said step (b) of moving the tapered mandrel upwardly to the top of the cavity, a step of replacing the mandrel having the open lower end with a mandrel having a blunt lower end surface.

6. The method according to claim 1, wherein said cap is configured to separate from the open end of the mandrel and is attached to the mandrel.

7. The method according to claim 6, wherein said cap is attached to the mandrel by a tether.

8. The method according to claim 7, wherein said tether is a chain or a cable.

9. A method of forming an aggregate pier comprising the steps of:

(a) driving downwardly into pier site soil a tapered mandrel having an open lower end initially covered by a removable and recoverable cap to form a downwardly tapered cavity to a desired depth for said aggregate pier while supporting a sidewall of the cavity;

(b) moving the tapered mandrel upwardly to a top of said cavity so as to separate said cap from said open end of the mandrel and recover said cap while delivering loose aggregate through said open end of the mandrel and depositing said delivered aggregate to the cavity so as to support said sidewall below said upwardly moved mandrel;

(c) repeating said steps (a) and (b) at a different portion of the pier site so as to form a plurality of said aggregate deposited cavities;

(d) driving downwardly into said aggregate deposited cavity a tapered mandrel having a blunt lower end surface so that said blunt lower end of the mandrel compacts said deposited aggregate and densities said soil;

(e) moving said tapered mandrel having the blunt lower end surface upwardly from said compacted aggregate and depositing additional loose aggregate in said cavity; and (f) repeating said steps (d) and (e) at each of said plurality of aggregate deposited cavities until a plurality of pier components of a desired height is formed.

* * * * *